US006249174B1

(12) United States Patent
Tsunezawa

(10) Patent No.: US 6,249,174 B1
(45) Date of Patent: Jun. 19, 2001

(54) SEMICONDUCTOR INTEGRATED CIRCUIT DEVICE WHICH SHORTENS THE TRANSITION TIME BETWEEN OPERATING AND STANDBY STATES

(75) Inventor: Masakazu Tsunezawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/362,725

(22) Filed: Jul. 29, 1999

(30) Foreign Application Priority Data

Feb. 23, 1999 (JP) ..... P11-044504

(51) Int. Cl.[7] ..... G05F 1/46
(52) U.S. Cl. ..... 327/538; 327/544
(58) Field of Search ..... 327/530, 538, 327/374, 544; 326/17, 83; 365/227

(56) References Cited

U.S. PATENT DOCUMENTS 4,835,417 * 5/1989 Kousaka et al. ..... 327/312
4,874,967 * 10/1989 Deane ..... 327/321
5,289,054 * 2/1994 Lucas ..... 327/328
5,355,033 * 10/1994 Jang ..... 326/83
5,390,147 * 2/1995 Smarandoiu et al. ..... 365/185.21

FOREIGN PATENT DOCUMENTS 60-112122 6/1985 (JP) ..... G05F/1/56
64-34014 2/1989 (JP) ..... H03K/17/04
2-134921 5/1990 (JP) ..... H03K/17/687

* cited by examiner

*Primary Examiner*—Timothy P. Callahan
*Assistant Examiner*—Terry L. Englund
(74) *Attorney, Agent, or Firm*—Burns, Doane, Swecker & Mathis, LLP

(57) ABSTRACT

A reference voltage generator circuit (RG1) includes a voltage generator (GP) having NMOS transistors (M7, M8, M9), PMOS transistors (M10, M11, M12, M13), an inverter (G4) and a resistor (R1), and a discharge path (DP1) having NMOS transistors (M14, M15, M16). The reference voltage generator circuit is capable of reducing the transition time required for a current cell matrix type D-A converter to make a standby-state to operating-state transition.

7 Claims, 13 Drawing Sheets

FIG. 11 <BACKGROUND ART>
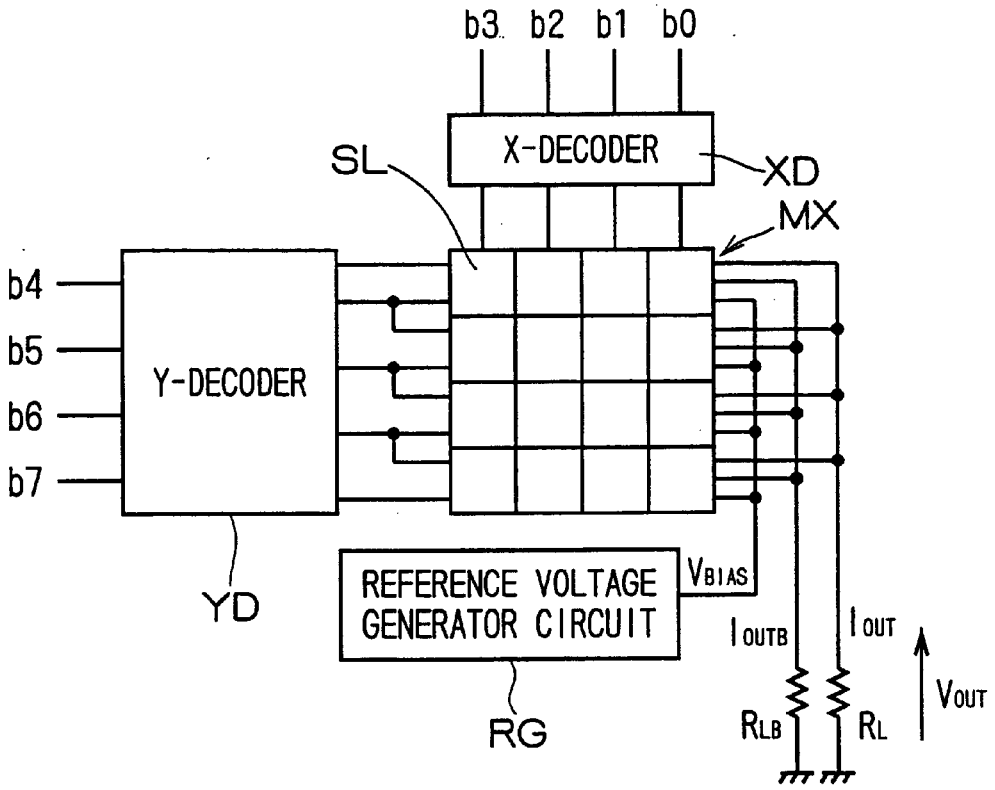

FIG. 12 <BACKGROUND ART>
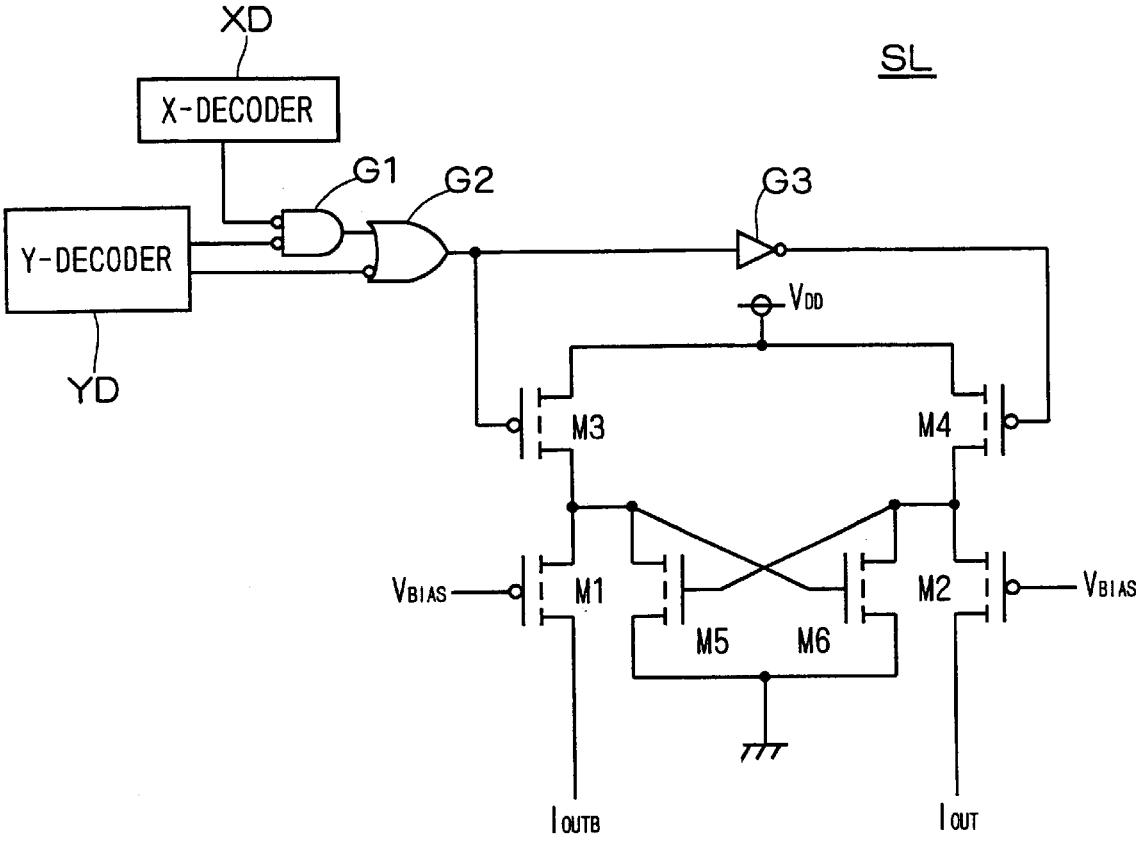

FIG. 13 <BACKGROUND ART>
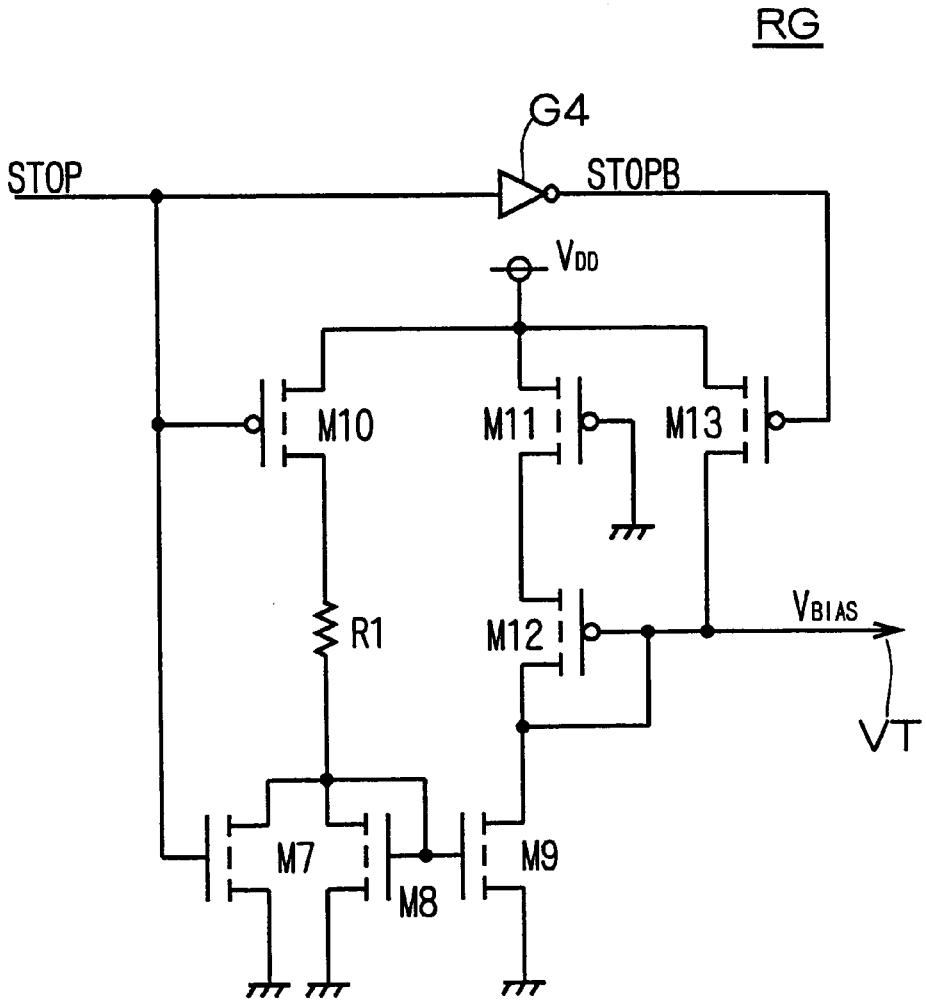

SEMICONDUCTOR INTEGRATED CIRCUIT DEVICE WHICH SHORTENS THE TRANSITION TIME BETWEEN OPERATING AND STANDBY STATES

BACKGROUND OF THE INVENTION

1. Field of the Invention

The present invention relates to a semiconductor integrated circuit device and, more particularly, to a semiconductor integrated circuit device incorporated in an analog circuit and used for generation of a reference voltage.

2. Description of the Background Art

As the trend toward multimedia information grows stronger, there is an increasing demand for a system for processing analog signals, such as audio and video signals, at high speeds and with high precision. A hybrid analog-digital LSI circuit which contains a MPU (Micro Controller Unit), a DSP (Digital Signal Processor), and D-A and A-D converters on a single semiconductor chip can achieve lower power consumption in addition to higher-speed and higher-precision operation, and is the mainstream of LSI development.

A digital circuit part of the hybrid analog-digital LSI circuit has been increased in the degree of integration with the progression of a MOS circuit micromachining technique, and has achieved the high-speed operation, high performance and low power consumption. However, the D-A and A-D converters of the hybrid analog-digital LSI circuit which are essential for system input and output have not yet achieved so high a degree of integration and so low power consumption as the digital circuit part under the constrains of machining precision and physical characteristics of transistors under present circumstances.

In recent years, products with the hybrid analog-digital LSI circuit incorporated in transportable equipment have been coming along. However, since the LSI circuit for incorporation in transportable equipment is assumed to be battery-operated, the reduction in power consumption of such an LSI circuit is the highest-priority technical object to be accomplished.

An example of high-speed, high-precision and low-power-consumption D-A converters manufactured using the CMOS process includes a current cell matrix type D-A converter. FIG. 11 is a block diagram showing the general construction of the current cell matrix type D-A converter.

As illustrated in FIG. 11, the current cell matrix type D-A converter comprises a cell matrix MX including a plurality of current source cells SL arranged in a matrix form, an X-decoder XD for specifying the row position of the cell matrix MX, a Y-decoder for specifying the column position of the cell matrix MX, and a reference voltage generator circuit RG for providing an operating voltage to the current source cells SL.

The X-decoder XD receives four bits b3, b2, b1 and b0 of input digital code, and the Y-decoder YD receives four bits b7, b6, b5 and b4 of input digital code. The number of current source cells SL to be turned on is established based on a total of eight bits of input digital code.

Each of the current source cells SL has two outputs $I_{OUT}$ and $I_{OUTB}$, the output $I_{OUT}$ being grounded through a resistor $R_L$, the output $I_{OUTB}$ being grounded through a resistor $R_{LB}$.

FIG. 12 shows the construction of a current source cell SL. The current source cell SL of FIG. 12 comprises an input section including an AND gate G1 having two inverting inputs and an OR gate G2 having two inputs one of which is connected to the output of the AND gate G1; P-channel MOS transistors (referred to hereinafter as PMOS transistors) M1, M2, M3, M4; and N-channel MOS transistors (referred to hereinafter as NMOS transistors) M5, M6.

In the input section, the two inputs of the AND gate G1 receive an output from the X-decoder XD and an output from the Y-decoder YD respectively, and the inverting input of the OR gate G2 receives another output from the Y-decoder YD.

Regarding the construction of the current source cell, the sources of the PMOS transistors M3 and M4 are connected to a power supply $V_{DD}$, and the drains of the PMOS transistors M3 and M4 are connected to the sources of the PMOS transistors M1 and M2, respectively. The drains of the PMOS transistors M1 and M2 provide respectively the outputs $I_{OUTB}$ and $I_{OUT}$ complementary to each other.

The drain of the PMOS transistor M3 is connected to the drain of the NMOS transistor M5, and the drain of the PMOS transistor M4 is connected to the drain of the NMOS transistor M6. The sources of the NMOS transistors M5 and M6 are grounded. The gate of the NMOS transistor M5 is connected to the drain of the NMOS transistor M6, and the gate of the NMOS transistor M6 is connected to the drain of the NMOS transistor M5.

A reference voltage $V_{BIAS}$ from the reference voltage generator circuit RG is applied to the gates of the PMOS transistors M1 and M2.

The output from the OR gate G2 is applied to the gate of the PMOS transistor M3 and is also inverted by an inverter G3. The inverter G3 applies the inverted output to the gate of the PMOS transistor M4.

The operation of the current cell matrix type D-A converter is described below. When predetermined input digital code is applied to the X-decoder XD and the Y-decoder YD, current source cells in the cell matrix MX the number of which corresponds to the input digital code turn on to supply currents which in turn are added together to flow into the load resistor $R_L$. Thus, the current cell matrix type D-A converter provides an analog output voltage corresponding to the input digital code.

The reason why the outputs $I_{OUTB}$ and $I_{OUT}$ from each current source cell SL are complementary to each other is to provide a constant amount of heat generated by the entire device independently of the input digital code.

The reference voltage generator circuit RG is a circuit for generating the reference voltage $V_{BIAS}$ required to operate the PMOS transistors M1 and M2 of each current source cell SL as a constant current source.

In the above described current cell matrix type D-A converter (also referred to simply as a D-A converter hereinafter), the reference voltage generator circuit RG is designed so that the reference voltage $V_{BIAS}$ generated by the reference voltage generator circuit RG during standby equals the voltage of the power supply $V_{DD}$ for reduction in power consumption during standby (when the system is suspended).

FIG. 13 shows the construction of the reference voltage generator circuit RG. As illustrated in FIG. 13, the reference voltage generator circuit RG comprises NMOS transistors M7, M8, M9, PMOS transistors M10, M11, M12, M13, an inverter G4, and a resistor R1.

The drains of the NMOS transistors M7 and M8 are connected to each other, and the sources of the NMOS transistors M7 and M8 are grounded. The PMOS transistor M10 has a drain connected through the resistor R1 to the drains of the NMOS transistors M7 and M8, and a source connected to the power supply $V_{DD}$. The PMOS transistor M11 has a gate grounded, a source connected to the power supply $V_{DD}$, and a drain connected to the source of the PMOS transistor M12. The PMOS transistor M12 has a drain connected to the drain of the NMOS transistor M9. The NMOS transistor M9 has a source grounded, and a gate connected to the gate of the NMOS transistor M8. The gate of the NMOS transistor M8 is connected to the drains of the NMOS transistor M7 and M8.

The PMOS transistor M13 has a source connected to the power supply $V_{DD}$, and a drain connected to the gate of the PMOS transistor M12. The gate of the PMOS transistor M12 is connected to the draw thereof. The drain of the PMOS transistor M13 and the gate of the PMOS transistor M12 are connected to an output end VT of the reference voltage $V_{BIAS}$.

A stop signal STOP which is one of the control signals provided from the exterior of the D-A converter is input to the gate of the PMOS transistor M10 and the gate of the NMOS transistor M7. An inverted stop signal STOPB obtained by inverting the stop signal STOP in the inverter G4 is input to the gate of the PMOS transistor M13.

The operation of the reference voltage generator circuit RG is described below. The stop signal STOP is a control signal for switching the D-A converter between an operating state and a standby state. In the operating state, the stop signal STOP is at a potential of low level (referred to hereinafter as "L"). This turns on the PMOS transistor M10 and turns off the NMOS transistor M7 and the PMOS transistor M13. Thus, the reference voltage generator circuit RG acts as a current mirror circuit to provide a predetermined operating voltage Vop as the reference voltage $V_{BIAS}$.

In the standby state, the stop signal STOP is at a potential of high level (referred to hereinafter as "H"). This turns on the NMOS transistor M7 and the PMOS transistor M13 and turns off the PMOS transistor M10. Thus, the reference voltage $V_{BIAS}$ equals the voltage ($V_{DD}$) of the power supply $V_{DD}$. In this case, the PMOS transistors M1 and M2 of the current source cell SL which receives the reference voltage $V_{BIAS}$ turn off, and the PMOS transistor M9 of the reference voltage generator circuit RG also turns off. Therefore, there is no path of current flowing from the power supply $V_{DD}$ to the ground (GND) in the reference voltage generator circuit RG and the current source cell SL, resulting in a small amount of power consumption.

With the D-A converter in the operating state, the time required for the stop signal STOP to rise from "L" to "H" to place the D-A converter into a complete standby state (i.e., transition time) is determined by the time required to charge the gates of the PMOS transistors M1 and M2 in the current source cell SL. Hence, the transition time may be controlled by changing the gate width of the PMOS transistor M13.

With the D-A converter in the standby state, on the other hand, when the stop signal STOP falls from "H" to "L," electric charges stored at the gates of the PMOS transistors M1 and M2 in the current source cell SL are discharged through the NMOS transistor M9 of the reference voltage generator circuit RG, thereby to decrease the reference voltage $V_{BIAS}$ from the power supply voltage $V_{DD}$ to the operating voltage level Vop. This transition time in the standby state is determined by the size of the NMOS transistor M9.

The size of the NMOS transistor M9 is set in consideration for the occupied area thereof in the reference voltage generator circuit RG and the power consumption during operation, for example, so that the NMOS transistor M9 acts as a source of current which is one-sixteenth the output $I_{OUT}$ from the current source cell SL when all bits of the input digital code applied to the X-decoder XD and the Y-decoder YD of the D-A converter are "1."

The transition time is not dramatically shortened even if the gate width of the NMOS transistor M9 is doubled. Therefore, the reference voltage generator circuit RG shown in FIG. 13 is not capable of arbitrarily controlling the standby-state to operating-state transition time.

FIG. 3A shows the stop signal STOP when supplied, and FIG. 3B shows a circuit simulation result of the D-A converter when the reference voltage generator circuit RG is used. Specifically, FIG. 3B shows plots of an output voltage Vout from the current source cell SL when all bits of the input digital code applied to the X-decoder XD and the Y-decoder YD are "1" and the stop signal STOP rises from "L" (i.e. 0 V) to "H" (i.e. full scale) at the time of 100 ns (nsec) and falls from "H" to "L" at the time of 500 ns as shown in FIG. 3A. The horizontal axis of FIGS. 3A and 3B represents elapsed time (sec) and the vertical axis represents voltage (V).

It is understood from FIG. 3B that the use of the background art reference voltage generator circuit RG results in the transition time of not less than 500 ns required for the stop signal STOP to fall to cause the D-A converter to make the standby-state to operating-state transition (defined herein as the time required for the output voltage Vout which is 0 V at the time of 500 ns to reach the operating-state value of the output voltage Vout±1 LSB). This transition time is a dozen times greater than the clock cycle of the D-A converter, and the D-A converter does not perform its normal operation during the transition time.

SUMMARY OF THE INVENTION

According to a first aspect of the present invention, a semiconductor integrated circuit device comprises: a first circuit serving as a main circuit and including a current source transistor; and a second circuit for generating a control voltage to be applied to a control electrode of the current source transistor of the first circuit, the second circuit being operative to turn off and on the current source transistor by setting the control voltage at first and second voltages thereby to place the first circuit in a standby state and in an operating state, respectively, the second circuit comprising: a current source and an output voltage setting device connected between first and second power supplies, the output voltage setting device setting an output voltage from the current source at the second voltage; an output end for outputting at least the output voltage from the current source; and voltage determination means connected to the output end, the voltage determination means forcing voltage of the control electrode of the current source transistor to approach the second voltage when placing the first circuit in the operating state.

Preferably, according to a second aspect of the present invention, in the semiconductor integrated circuit device of the first aspect, the voltage determination means comprises at least one diode-connected transistor connected between the output end and the second power supply. The voltage determination means forces the voltage of the control electrode of the current source transistor to approach the second voltage until the voltage of the control electrode of the current source transistor reaches a threshold voltage of the at least one diode-connected transistor when placing the first circuit in the operating state.

Preferably, according to a third aspect of the present invention, in the semiconductor integrated circuit device of the second aspect, the second circuit further comprises switching means connected between the first power supply and the output end for making and breaking connection between the first power supply and the output end. The voltage determination means further comprises: a first transistor of a first conductivity type having a first main electrode connected to the output end, a second main electrode, and a control electrode connected to the first main electrode of the first transistor; a second transistor of the first conductivity type having a first main electrode connected to the second main electrode of the first transistor, a second main electrode, and a control electrode connected to the first main electrode of the second transistor; and a third transistor of the first conductivity type having a first main electrode connected to the second main electrode of the second transistor, a second main electrode connected to the second power supply, and a control electrode. The switching means comprises a fourth transistor of a second conductivity type having a first main electrode connected to the first power supply, a second main electrode connected to the output end, and a control electrode, the control electrodes of the third and fourth transistors receiving a control signal for turning off the third transistor and turning on the fourth transistor when placing the first circuit in the standby state.

Preferably, according to a fourth aspect of the present invention, in the semiconductor integrated circuit device of the first aspect, the voltage determination means comprises at least a transistor connected between the output end and the second power supply. The second circuit further comprises at least one inverter for on-off controlling the transistor, the at least one inverter having an input connected to the output end, the transistor being on-off controlled based on an output from the at least one inverter. The transistor is held on until the voltage of the control electrode of the current source transistor reaches a threshold voltage of the at least one inverter when placing the first circuit in the operating state.

Preferably, according to a fifth aspect of the present invention, in the semiconductor integrated circuit device of the fourth aspect, the second circuit further comprises switching means connected between the first power supply and the output end for making and breaking connection between the first power supply and the output end. The at least one inverter comprises first and second inverters connected in series, the first inverter having an input connected to the output end, and an output, the second inverter having an input connected to the output of the first inverter, and an output. The voltage determination means further comprises: a first transistor of a first conductivity type having a first main electrode connected to the output end, a second main electrode, and a control electrode connected to the output of the second inverter; and a second transistor of the first conductivity type having a first main electrode connected to the second main electrode of the first transistor, a second main electrode connected to the second power supply, and a control electrode. The switching means comprises a third transistor of a second conductivity type having a first main electrode connected to the first power supply, a second main electrode connected to the output end, and a control electrode, the control electrodes of the second and third transistors receiving a control signal for turning off the second transistor and turning on the third transistor when placing the first circuit in the standby state.

Preferably, according to a sixth aspect of the present invention, in the semiconductor integrated circuit device of the first aspect, the voltage determination means comprises at least a transistor connected between the output end and the second power supply. The second circuit further comprises a controller for on-off controlling the transistor, the controller including at least a Schmitt gate, the Schmitt gate having an input connected to the output end, the transistor being on-off controlled based on an output from the Schmitt gate, the Schmitt gate having a first threshold voltage for specifying voltage at which the output changes from a first level to a second level, and a second threshold voltage for specifying voltage at which the output changes from the second level to the first level. The transistor is held on until the voltage of the control electrode of the current source transistor reaches the first threshold voltage of the Schmitt gate when placing the first circuit in the operating state.

Preferably, according to a seventh aspect of the present invention, in the semiconductor integrated circuit device of the sixth aspect, the second circuit further comprises switching means connected between the first power supply and the output end for making and breaking connection between the first power supply and the output end. The controller further includes an inverter having an input connected to the output of the Schmitt gate, and an output. The voltage determination means further comprises: a first transistor of a first conductivity type having a first main electrode connected to the output end, a second main electrode, and a control electrode connected to the output of the inverter; and a second transistor of the first conductivity type having a first main electrode connected to the second main electrode of the first transistor, a second main electrode connected to the second power supply, and a control electrode. The Schmitt gate comprises: a third transistor of the first conductivity type having a first main electrode connected to the second power supply, a second main electrode, and a control electrode; a fourth transistor of the first conductivity type having a first main electrode connected to the second main electrode of the third transistor, a second main electrode, and a control electrode; a fifth transistor of a second conductivity type having a first main electrode connected to the second main electrode of the fourth transistor, a second main electrode connected to the first power supply, and a control electrode; and a sixth transistor of the first conductivity type having a first main electrode connected to the first main electrode of the fourth transistor, a second main electrode connected to the first power supply, and a control electrode, the control electrodes of the third, fourth and fifth transistors being connected to the output end, the control electrode of the sixth transistor being connected to the first main electrode of the fifth transistor serving as the output of the Schmitt gate. The switching means comprises a seventh transistor of the second conductivity type having a first main electrode connected to the first power supply, a second main electrode connected to the output end, and a control electrode, the control electrodes of the second and seventh transistors receiving a control signal for turning off the second transistor and turning on the seventh transistor when placing the first circuit in the standby state.

The semiconductor integrated circuit device according to the first aspect of the present invention comprises the voltage determination means which forces the voltage of the control electrode of the current source transistor of the first circuit to approach the second voltage when placing the first circuit in the operating state. This shortens the time required for voltage determination to reduce the time required for the first circuit, i.e. the semiconductor integrated circuit device, to make a standby-state to operating-state transition. When the semiconductor integrated circuit device is in the standby state, the voltage of the control electrode of the current source transistor equals the voltage of the first power supply to completely turn off the current source transistor. This reduces power consumption in the standby state.

In the semiconductor integrated circuit device according to the second aspect of the present invention, the voltage determination means is simple in construction to suppress the increase in device size and manufacturing costs resulting from the provision of the voltage determination means.

In the semiconductor integrated circuit device according to the third aspect of the present invention, the switching means makes the connection between the first power supply and the output end when the first circuit is in the standby state. Then, the voltage of the first power supply is outputted as the first voltage from the output end. The third transistor turns off to disconnect the second power supply from the output end. This prevents current from flowing through the voltage determination means, and accomplishes the voltage determination means simple in construction.

In the semiconductor integrated circuit device according to the fourth aspect of the present invention, the transistor of the voltage determination means is on-off controlled by the inverter. Therefore, the threshold voltage of the inverter may be set to any value by changing the size of a transistor constituting the inverter. Accordingly, the time required for the first circuit, i.e. the semiconductor integrated circuit device, to make the standby-state to operating-state transition may be set to any value.

In the semiconductor integrated circuit device according to the fifth aspect of the present invention, the switching means makes the connection between the first power supply and the output end when the first circuit is in the standby state. Then, the voltage of the first power supply is outputted as the first voltage from the output end. The second transistor turns off to disconnect the second power supply from the output end. This prevents current from flowing through the voltage determination means, and accomplishes the semiconductor integrated circuit device including the second circuit which can set the time required for the semiconductor integrated circuit device to make the standby-state to operating-state transition to any value.

In the semiconductor integrated circuit device according to the sixth aspect of the present invention, the transistor of the voltage determination means is on-off controlled by the Schmitt gate having the first and second threshold voltages and having an input-output characteristic which exhibits a hysteresis curve. Therefore, the output from the Schmitt gate is not changed by some variations in voltage of the output end, and the on-off control of the transistor of the voltage determination means is stabilized. Additionally, the Schmitt gate is less susceptible to variations in the process of manufacturing transistors of the current source and the Schmitt gate. This provides the second circuit which is low in failure rate and high in manufacturing yield.

In the semiconductor integrated circuit device according to the seventh aspect of the present invention, the switching means makes the connection between the first power supply and the output end when the first circuit is in the standby state. Then, the voltage of the first power supply is outputted as the first voltage from the output end. The second transistor turns off to disconnect the second power supply from the output end. This prevents current from flowing through the voltage determination means, and accomplishes the semiconductor integrated circuit device including the second circuit which can on-off control the transistor of the voltage determination means with stability independently of some variations in voltage of the output end.

It is therefore an object of the present invention to provide a reference voltage generator circuit which is capable of reducing the transition time required for a current cell matrix time D-A converter to make a standby-state to operating-state transition.

These and other objects, features, aspects and advantages of the present invention will become more apparent from the following detailed description of the present invention when taken in conjunction with the accompanying drawings.

BRIEF DESCRIPTION OF THE DRAWINGS

FIG. 11 shows a construction of a current cell matrix type D-A converter;

FIG. 12 shows a construction of a current source cell; and

FIG. 13 shows a construction of a background art reference voltage generator circuit.

DESCRIPTION OF THE PREFERRED EMBODIMENTS

<Overview of the Invention>

The present invention features a reference voltage generator circuit containing a discharge path for discharging electric charges stored at the gate of a MOS transistor serving as a current source of a current source cell or a charge path for charging the gate of the MOS transistor to reduce the transition time required for a current cell matrix type D-A converter to make a standby-state to operating-state transition.

Therefore, the current cell matrix type D-A converter (also referred to simply as a D-A converter hereinafter) according to the present invention is similar in construction to the background art current cell matrix type D-A converter illustrated in FIGS. 11 and 12 except the reference voltage generator circuit. Description will be given below also with reference to FIGS. 11 and 12.

<A. First Preferred Embodiment>

<A-1. Device Construction>

Figure 1:
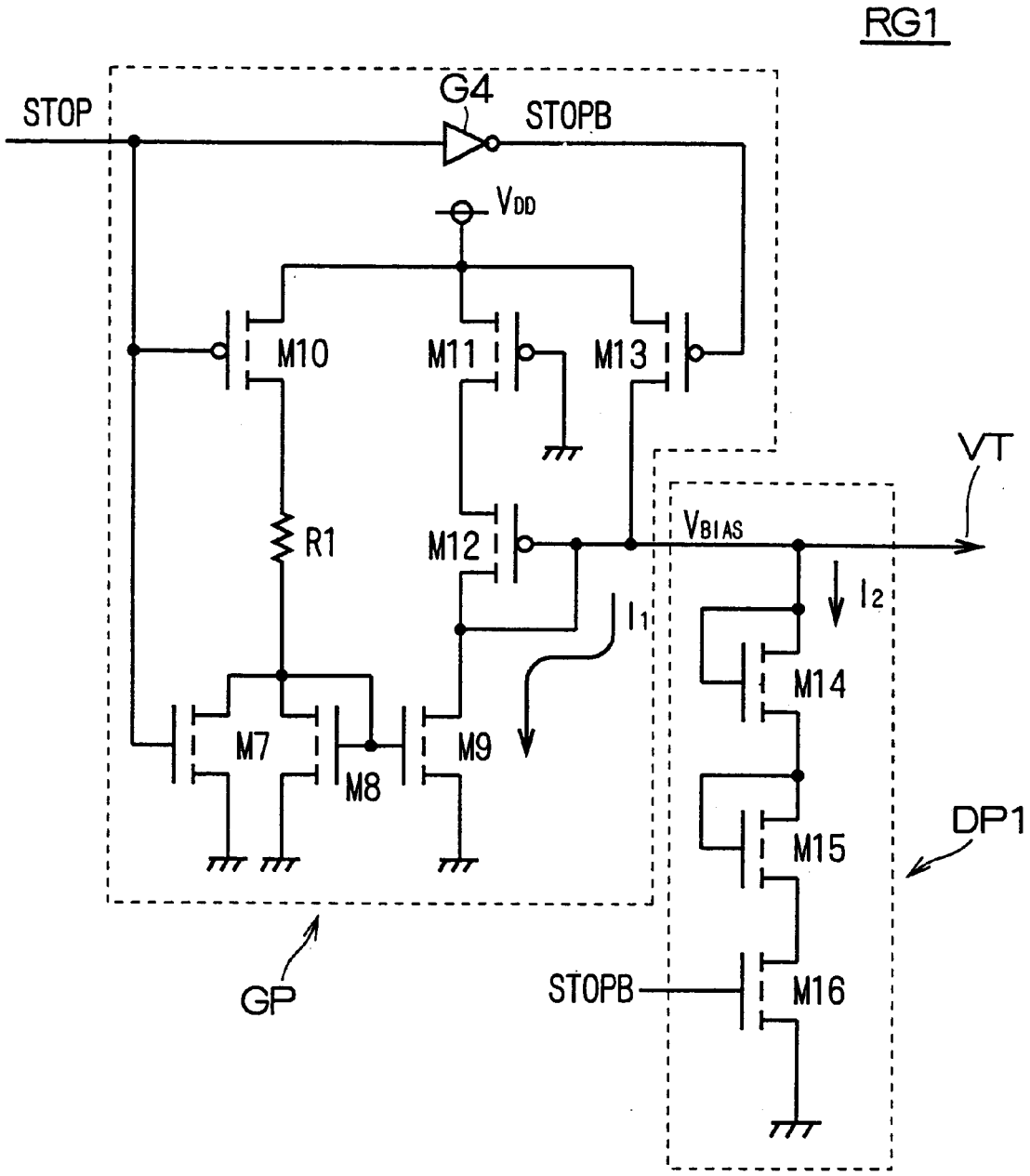
FIG. 1 shows a construction of a semiconductor integrated circuit device according to a first preferred embodiment of the present invention.

FIG. 1 shows the construction of a reference voltage generator circuit RG1 according to a first preferred embodiment of the present invention. As illustrated in FIG. 1, the reference voltage generator circuit RG1 comprises a discharge path DP1 including NMOS transistors M14, M15, M16 in addition to a voltage generator GP including NMOS transistors M7, M8, M9, PMOS transistors M10, M11, M12, M13, an inverter G4 and a resistor R1.

The drains of the NMOS transistors M7 and M8 are connected to each other, and the sources of the NMOS transistors M7 and M8 are grounded. The PMOS transistor M10 has a drain connected through the resistor R1 to the drains of the NMOS transistors M7 and M8, and a source connected to a power supply $V_{DD}$. The PMOS transistor M11 has a gate grounded, a source connected to the power supply $V_{DD}$, and a drain connected to the source of the PMOS transistor M12. The PMOS transistor M12 has a drain connected to the drain of the NMOS transistor M9. The NMOS transistor M9 has a source grounded, and a gate connected to the gate of the NMOS transistor M8. The gate of the NMOS transistor M8 is connected to the drains of the NMOS transistors M7 and M8.

The PMOS transistor M13 has a source connected to the power supply $V_{DD}$, and a drain connected to the gate of the PMOS transistor M12. The gate of the PMOS transistor M12 is connected to the drain thereof.

The drain of the PMOS transistor M13 and the gate of the PMOS transistor M12 are connected to an output end VT of a reference voltage $V_{BIAS}$.

The output end VT of the reference voltage $V_{BIAS}$ is connected to the drain of the diode-connected NMOS transistor M14. The source of the NMOS transistor M14 is connected to the drain of the diode-connected NMOS transistor M15. The source of the NMOS transistor M15 is connected to the drain of the NMOS transistor M16. The source of the NMOS transistor M16 is grounded.

A stop signal STOP which is one of the control signals provided from the exterior of the D-A converter is input to the gate of the PMOS transistor M10 and the gate of the NMOS transistor M7. An inverted stop signal STOPB obtained by inverting the stop signal STOP in the inverter G4 is input to the gate of the PMOS transistor M13 and the gate of the NMOS transistor M16.

With reference to FIG. 1, the diode-connected NMOS transistors M14 and M15 are connected in series to provide a combined diode having a desired threshold value. The threshold value Vtot of the combined diode is represented by the sum of the threshold value Vth14 of the NMOS transistor M14 and the threshold value Vth15 of the NMOS transistor M15. The number of NMOS transistors to be connected in series is determined so that the threshold value Vtot of the combined diode is greater than an operating voltage Vop which equals the reference voltage $V_{BIAS}$ provided when the D-A converter is in operation (Vtot>Vop).

The inverted stop signal STOPB is applied to the NMOS transistor M16 so that the NMOS transistor M16 serves as a switch which is on when the D-A converter is in operation and is off when the D-A converter is on standby.

<A-2. Device Operation>

The operation of the reference voltage generator circuit RG1 will be discussed below.

When the potential of the stop signal STOP is switched from a high level (referred to hereinafter as "H") to a low level (referred to hereinafter as "L") for the standby-state to operating-state transition of the D-A converter, the PMOS transistor M13 turns off and the NMOS transistors M9 and M16 turn on. Then, current I1 flows through a conventional path extending from the output end VT around the PMOS transistor M12 to the NMOS transistor M9, and current I2 flows through the discharge path DP1, thereby to discharge electric charges stored at the gates of the PMOS transistors M1 and M2 of the current source cell SL shown in FIG. 12. When the discharge proceeds to cause the voltage at the output end VT, i.e. the voltage $V_{BIAS}$, to be lower than the threshold value Vtot of the combined diode (Vtot>$V_{BIAS}$), the NMOS transistors M14 and M15 turn off. Then, the discharge caused by the current I1 flowing through the conventional path decreases the voltage $V_{BIAS}$ at the output end VT to the operating voltage Vop which equals the reference voltage $V_{BIAS}$ provided when the D-A converter is in operation.

Figure 2:
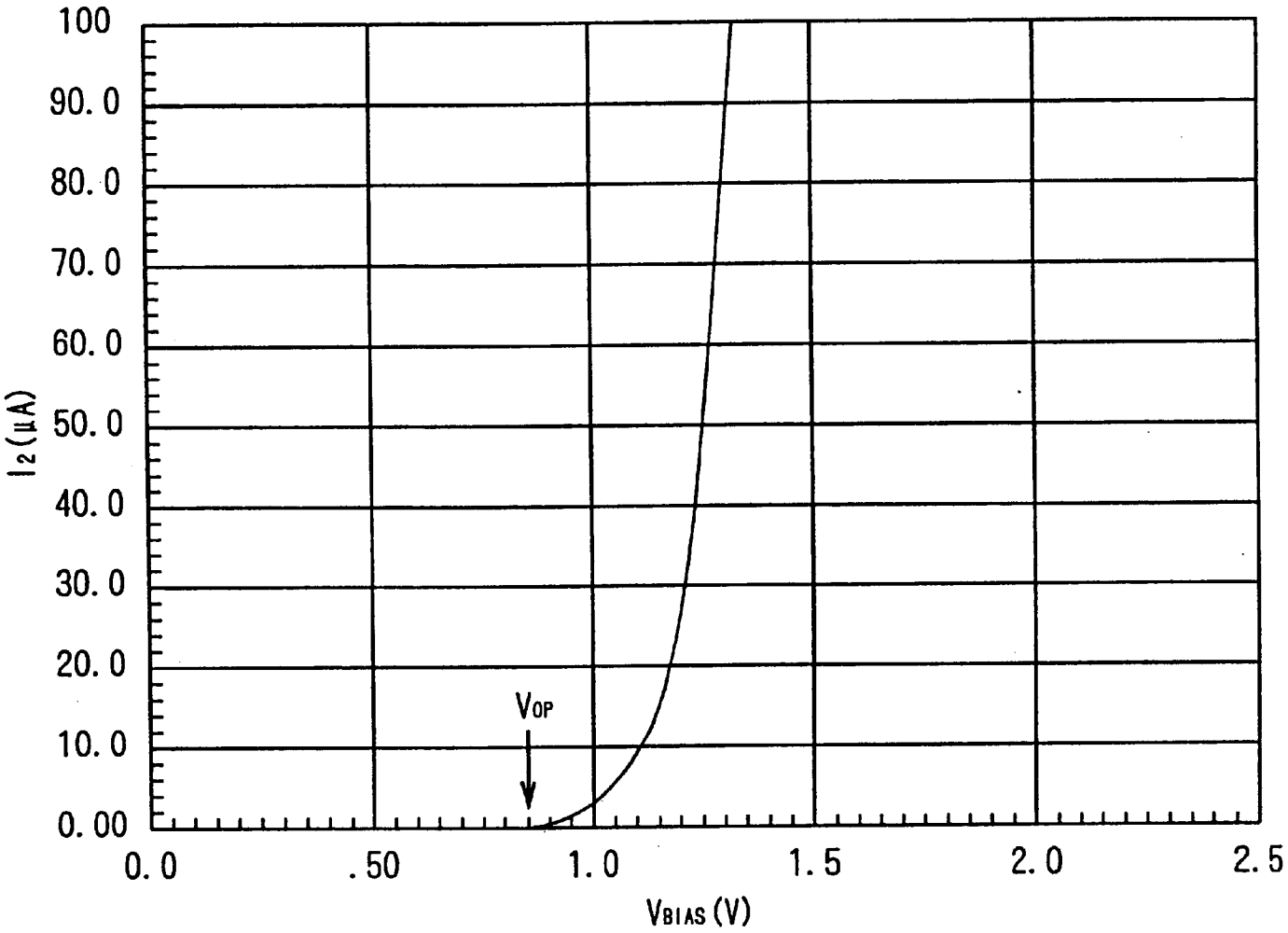
FIG. 2 illustrates discharge path characteristics of the semiconductor integrated circuit device according to the first preferred embodiment of the present invention.

FIG. 2 shows current-voltage characteristics of the combined diode comprised of the diode-connected NMOS transistors M14 and M15.

In the operating state, the PMOS transistor M10 is on, and the NMOS transistor M7 and the PMOS transistor M13 are off. Thus, the reference voltage generator circuit RG1 acts as a current mirror circuit to provide the predetermined operating voltage Vop as the reference voltage $V_{BIAS}$.

The graph of FIG. 2 shows the voltage $V_{BIAS}$ (V) at the output end VT measured along the horizontal axis against the current I2 ($\mu$A) flowing through the discharge path DP1 which is measured along the vertical axis. It will be understood from FIG. 2 that the current 12 is relatively high and the discharge through the discharge path DP1 is predominant when the voltage $V_{BIAS}$ is, for example, not less than 1.0, but the current 12 is extremely low and little current flows through the discharge path DP1 when the voltage $V_{BIAS}$ is less than 1.0. The operating voltage Vop provided when the D-A converter is in operation is represented by the arrow of FIG. 2.

Figure 3A:
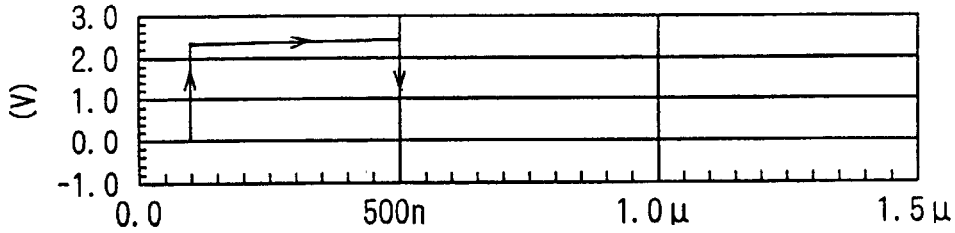
FIG. 3A BACKGROUND ART
FIGS. 3A through 3E show operating characteristics of the semiconductor integrated circuit device according to the background art and first to third preferred embodiments of the present invention.
Figure 3B:
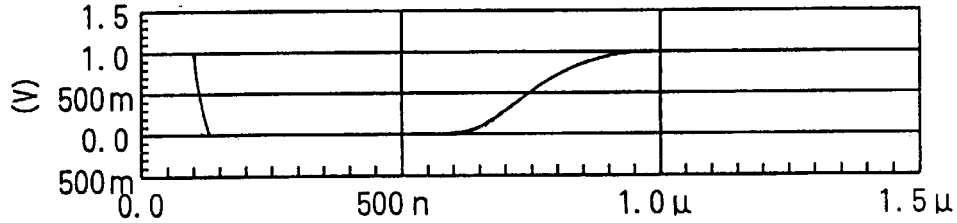
FIG. 3B BACKGROUND ART
Figure 3C:
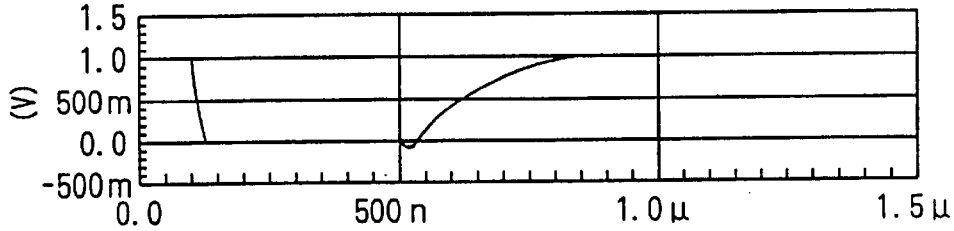

FIG. 3C shows a circuit simulation result of the D-A converter when the reference voltage generator circuit RG1 is used. Specifically, FIG. 3C shows plots of an output voltage Vout from the current source cell SL when all bits of input digital code applied to an X-decoder XD and a Y-decoder YD are "1" and the stop signal STOP rises from "L" (i.e. 0 V ) to "H" (i.e. full scale) at the time of 100 ns (nsec) and falls from "H" to "L" at the time of 500 ns as shown in FIG. 3A. The horizontal axis of FIG. 3C represents elapsed time (sec) and the vertical axis represents voltage (V). FIG. 3A shows the stop signal STOP when supplied. The horizontal axis of FIG. 3A represents the elapsed time (sec) and the vertical axis represents the voltage (V) of the stop signal STOP.

Immediately after the stop signal STOP falls from "H" to "L" at the time of 500 ns as shown in FIG. 3A, the current 12 flowing through the discharge path DP1 is predominant to cause short-time discharge. As a result, the output voltage Vout from the current source cell SL rises quickly as shown in FIG. 3C. However, the predominant discharge current gradually shifts from the current 12 to the current I1 flowing through the conventional path as described with reference to FIG. 2, slowing down changes in output voltage Vout.

The transition time required for the stop signal STOP to fall to cause the D-A converter to make the standby-state to operating-state transition (defined herein as the time required for the output voltage Vout which is 0 V at the time of 500 ns to reach the operating-state value of the output voltage Vout±1 LSB) when the reference voltage generator circuit RG1 is used is reduced by about 20% as compared with the characteristic shown in FIG. 3B which is obtained when the background art reference voltage generator circuit RG is used.

The number of diode-connected NMOS transistors constituting the discharge path DP1 may be set in accordance with the value of the reference voltage $V_{BIAS}$ provided when the D-A converter is in operation, and is not limited to two as illustrated in FIG. 1. However, if an increased number of diode-connected NMOS transistors are used, the gate width of the diode-connected NMOS transistors is increased in some cases for the purpose of high-speed initial discharge.

<A-3. Function and Effect>

As described hereinabove, the reference voltage generator circuit RG1 comprises the discharge path DP1 for discharging the electric charges stored at the gates of the PMOS transistors M1 and M2 of the current source cell SL to shorten discharge time, thereby reducing the time required for the D-A converter to make the standby-state to operating-state transition.

The discharge path DP1 is simple in construction to suppress the increase in device size and manufacturing costs resulting from the provision of the discharge path DP1.

When the D-A converter is in the standby state, the reference voltage $V_{BIAS}$ generated by the reference voltage generator circuit RG1 equals the power supply voltage, and there is no path of current flowing from the power supply $V_{DD}$ to the ground (GND) in the reference voltage generator circuit RG1 and the current source cell SL. This reduces power consumption.

<A-4. Modification>

Figure 4:
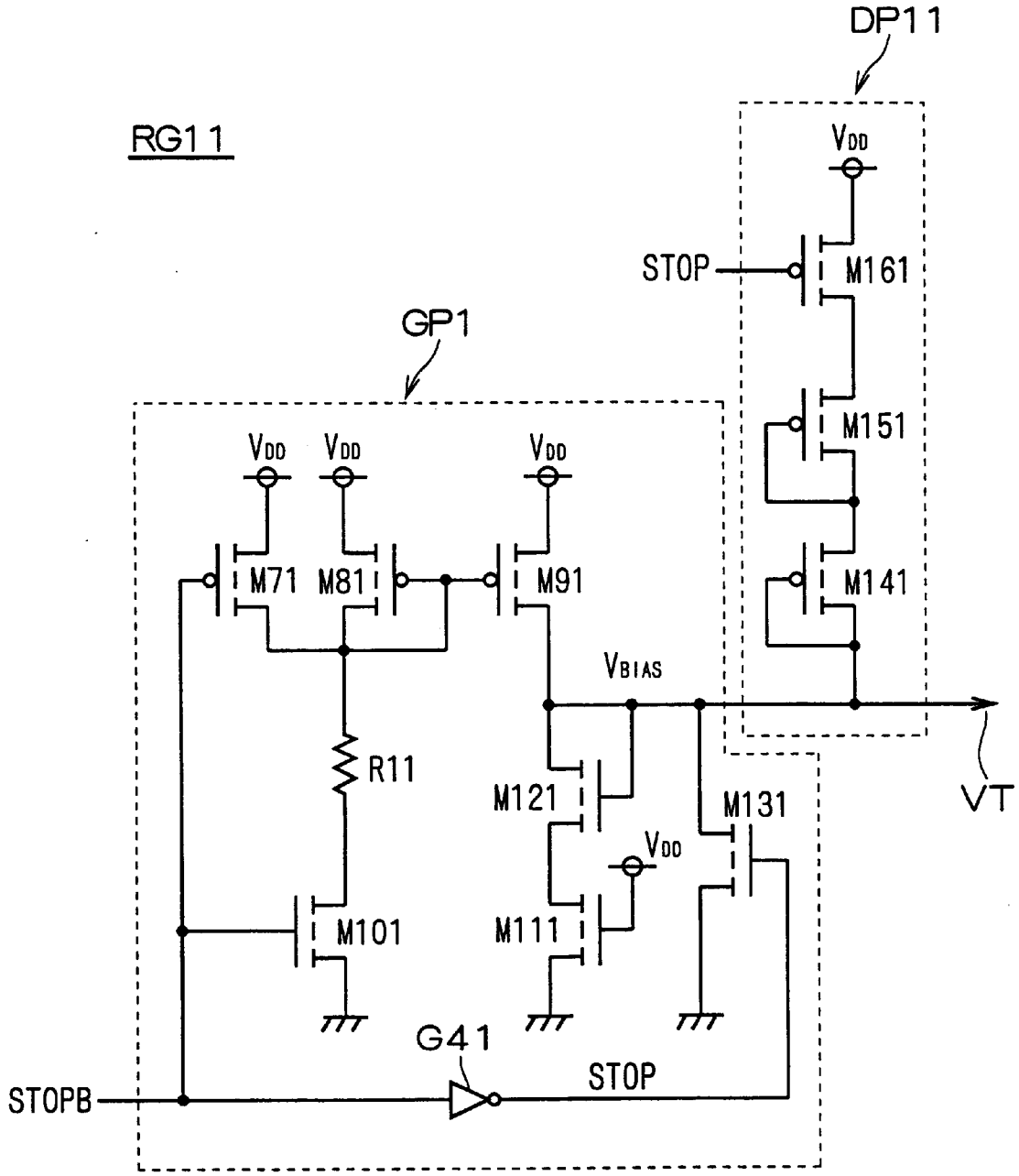
FIG. 4 shows a construction of a modification of the semiconductor integrated circuit device according to the first preferred embodiment of the present invention.

The above described reference voltage generator circuit RG1 according to the first preferred embodiment of the present invention is designed to discharge the electric charges in the MOS transistor when the MOS transistor serving as the current source of the current source cell is of P-channel type. When the current source is an NMOS transistor, the NMOS transistor is required to store electric charges therein. A reference voltage generator circuit RG11 as shown in FIG. 4 is applied to such a requirement.

The reference voltage generator circuit RG11 comprises a charge path DP11 including PMOS transistors M141, M151, M161 in addition to a voltage generator GP1 including PMOS transistors M71, M81, M91, NMOS transistors M101, M111, M121, M131, an inverter G41 and a resistor R11.

The drains of the PMOS transistors M71 and M81 are connected to each other, and the sources of the PMOS transistors M71 and M81 are connected to the power supply $V_{DD}$. The NMOS transistor M101 has a drain connected through the resistor R11 to the drains of the PMOS transistors M71 and M81, and a source grounded. The NMOS transistor M111 has a gate connected to the power supply $V_{DD}$, a source grounded, and a drain connected to the source of the NMOS transistor M121. The NMOS transistor M121 has a drain connected to the drain of the PMOS transistor M91. The PMOS transistor M91 has a source connected to the power supply $V_{DD}$, and a gate connected to the gate of the PMOS transistor M81. The gate of the PMOS transistor M81 is connected to the drains of the PMOS transistors M71 and M81.

The NMOS transistor M131 has a source grounded, and a drain connected to the gate of the NMOS transistor M121. The gate of the NMOS transistor M121 is connected to the drain thereof.

The drain of the NMOS transistor M131 and the gate of the NMOS transistor M121 are connected to the output end VT of the reference voltage $V_{BIAS}$.

The output end VT of the reference voltage $V_{BIAS}$ is connected to the drain of the diode-connected PMOS transistor M141. The source of the PMOS transistor M141 is connected to the drain of the diode-connected PMOS transistor M151. The source of the PMOS transistor M151 is connected to the drain of the PMOS transistor M161. The source of the PMOS transistor M161 is connected to the power supply $V_{DD}$.

The inverted stop signal STOPB which is one of the control signals provided from the exterior of the D-A converter is input to the gate of the NMOS transistor M101 and the gate of the PMOS transistor M71. The stop signal STOP obtained by inverting the inverted stop signal STOPB in the inverter G41 is input to the gate of the NMOS transistor M131 and the gate of the PMOS transistor M161.

With such an arrangement, when the D-A converter is in the standby state (when the system is suspended), the reference voltage $V_{BIAS}$ generated by the reference voltage generator circuit RG11 equals the ground potential. This reduces power consumption. Further, when the inverted stop signal STOPB changes from "L" to "H" to cause the D-A converter to make the standby-state to operating-state transition, electric charges are supplied through the charge path DP11 to the gate of the NMOS transistor serving as the current source of the current source cell. This shortens charge time, thereby to reduce the time required for the D-A converter to make the standby-state to operating-state transition.

The discharge path DP1 in the reference voltage generator circuit RG1 shown in FIG. 1 and the charge path DP11 in the reference voltage generator circuit RG11 shown in FIG. 4 are means for causing the gate voltage of the transistor serving as the current source of the current source cell to quickly approach the operating voltage Vop to determine the voltage, and may therefore be referred generically as voltage determination means.

<B. Second Preferred Embodiment>

<B-1. Device Construction>

Figure 5:
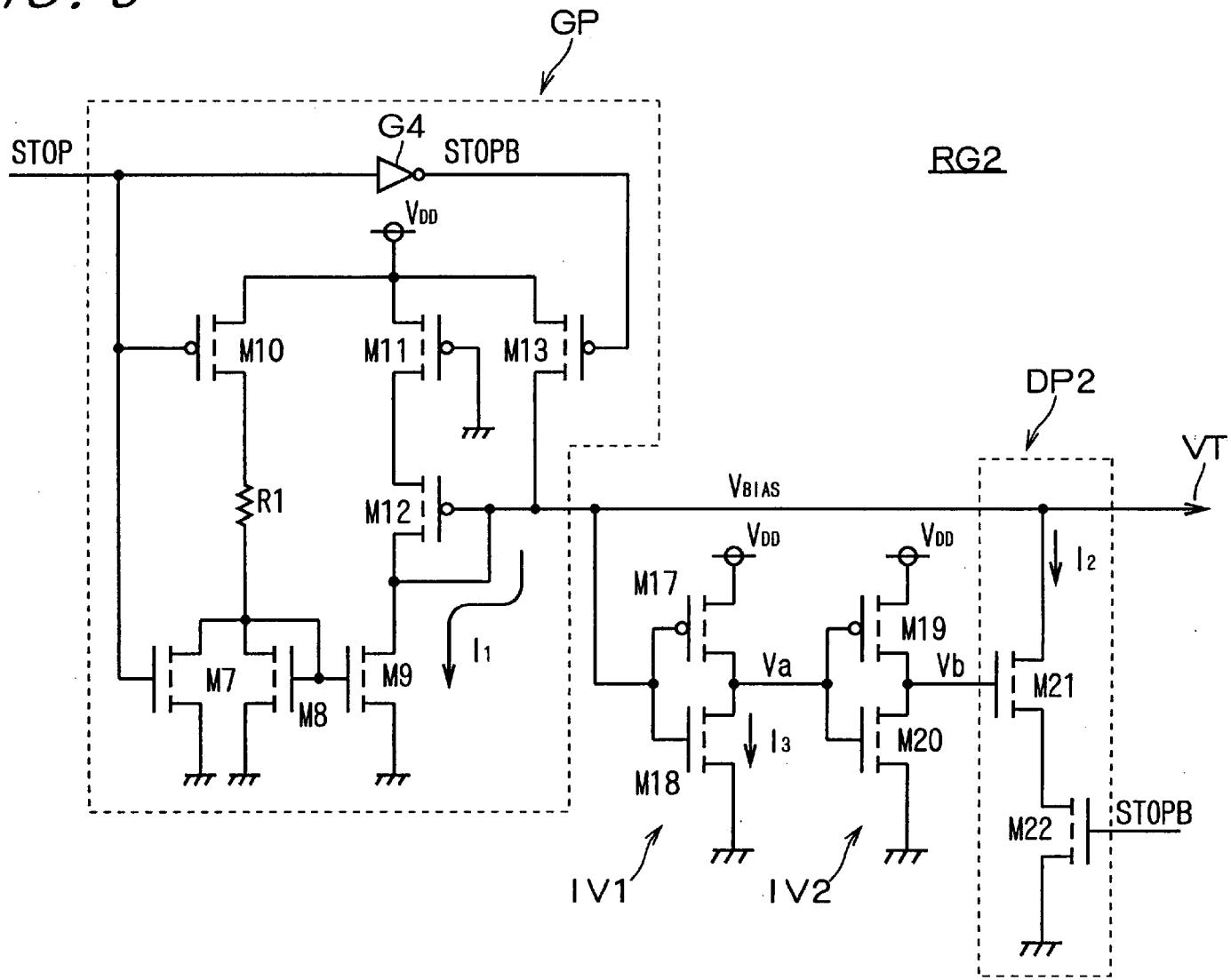
FIG. 5 shows a construction of the semiconductor integrated circuit device according to a second preferred embodiment of the present invention.

FIG. 5 shows the construction of a reference voltage generator circuit RG2 according to a second preferred embodiment of the present invention. As illustrated in FIG. 5, the reference voltage generator circuit RG2 comprises a discharge path DP2 including NMOS transistors M21 and M22, and CMOS inverters IV1 and IV2 (referred to simply as inverters IV1 and IV2 hereinafter) for on-off controlling the discharge path DP2 in addition to the voltage generator GP including the NMOS transistors M7, M8, M9, the PMOS transistors M10, M11, M12, M13, the inverter G4 and the resistor R1.

The voltage generator GP of the reference voltage generator circuit RG2 is similar in construction to that of the reference voltage generator circuit RG1 described with reference to FIG. 1, and duplicate description thereon will be omitted herein.

The inverter IV1 comprises a PMOS transistor M17 and an NMOS transistor M18 which are connected in series between the power supply $V_{DD}$ and the ground. The gate of the PMOS transistor M17 and the gate of the NMOS transistor M18 are connected to the output end VT of the reference voltage $V_{BIAS}$. The inverter IV2 comprises a PMOS transistor M19 and an NMOS transistor M20 which are connected in series between the power supply $V_{DD}$ and the ground. The gate of the PMOS transistor M19 and the gate of the NMOS transistor M20 are connected to the output of the inverter IV1, i.e. the drains of the PMOS transistor M17 and the NMOS transistor M18.

In the discharge path DP2, the output end VT of the reference voltage $V_{BIAS}$ is connected to the drain of the NMOS transistor M21. The source of the NMOS transistor M21 is connected to the drain of the NMOS transistor M22. The source of the NMOS transistor M22 is grounded. The gate of the NMOS transistor M21 is connected to the output of the inverter IV2, i.e. the drains of the PMOS transistor M19 and the NMOS transistor M20.

The stop signal STOP which is one of the control signals provided from the exterior of the D-A converter is input to the gate of the PMOS transistor M10 and the gate of the NMOS transistor M7. The inverted stop signal STOPB obtained by inverting the stop signal STOP in the inverter G4 is input to the gate of the PMOS transistor M13 and the gate of the NMOS transistor M22.

In the discharge path DP2, the NMOS transistor M21 is on-off controlled by the inverted signal of the output from the inverter IV1 which receives the reference voltage $V_{BIAS}$. The inverted stop signal STOPB is applied to the NMOS transistor M22 so that the NMOS transistor M22 serves as a switch which is on when the D-A converter is in operation and is off when the D-A converter is on standby.

The gate length and width of the PMOS transistor M17 and the NMOS transistor M18 are set so that a threshold value $V_{IV1}$ of the inverter IV1 is greater than the operating voltage Vop which equals the reference voltage $V_{BIAS}$ provided when the D-A converter is in operation ($Vop<V_{IV1}$). A threshold value of the inverter IV2 is set to about one-half the power supply voltage ($V_{DD}/2$). The threshold value of the inverter means a voltage at which the output from the inverter is switched.

<B-2. Device Operation>

The operation of the reference voltage generator circuit RG2 will be discussed below.

When the potential of the stop signal STOP is switched from the high level (referred to hereinafter as "H" ) to the low level (referred to hereinafter as "L" ) for the standby-state to operating-state transition of the D-A converter, the PMOS transistor M13 turns off and the NMOS transistors M9 and M22 turn on. Since the voltage generator GP holds the reference voltage $V_{BIAS}$ at the voltage of the power supply $V_{DD}$ when the D-A converter is in the standby state, the reference voltage $V_{BIAS}$ is approximately equal to the power supply voltage ($V_{DD}$) immediately after the stop signal STOP is switched. Hence, an output voltage Va from the inverter IV1 is "L," and an output voltage Vb from the inverter IV2 is "H." Then, the NMOS transistor M21 turns on. Since the NMOS transistor M22 also turns on, the current I1 flows through the conventional path extending from the output end VT around the PMOS transistor M12 to the NMOS transistor M9, and the current 12 flows through the discharge path DP2 including the NMOS transistors M21 and M22, thereby to discharge electric charges stored at the gates of the PMOS transistors M1 and M2 of the current source cell SL shown in FIG. 12. An initial discharge rate may be set to any value according to the size of the NMOS transistor M21.

When the discharge proceeds to cause the voltage at the output end VT, i.e. the voltage $V_{BIAS}$, to be lower than the threshold value $V_{Iv1}$ of the inverter IV1 ($V_{IV1}>V_{BIAS}$), the output voltage Va from the inverter IV1 changes to "H" and the output voltage Vb from the inverter IV2 changes to "L," to turn off the NMOS transistor M21. Then, the discharge caused by the current I1 flowing through the conventional path decreases the voltage $V_{BIAS}$ at the output end VT to the operating voltage Vop which equals the reference voltage $V_{BIAS}$ provided when the D-A converter is in operation.

Figure 3D:
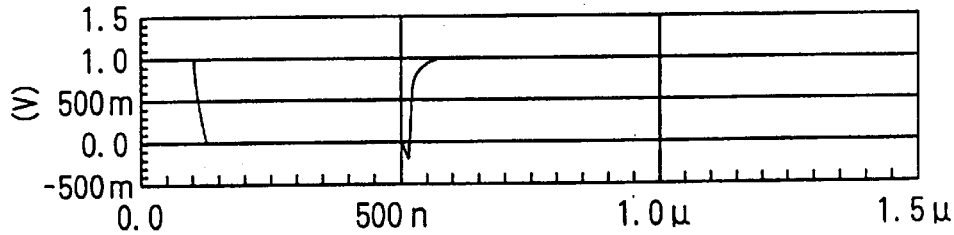

FIG. 3D shows a circuit simulation result of the D-A converter when the reference voltage generator circuit RG2 is used. Specifically, FIG. 3D shows plots of the output voltage Vout from the current source cell SL when all bits of input digital code applied to the X-decoder XD and the Y-decoder YD are "1" and the stop signal STOP rises from "L" (i.e. 0 V ) to "H" (i.e. full scale) at the time of 100 ns (nsec) and falls from "H" to "L" at the time of 500 ns as shown in FIG. 3A. The horizontal axis of FIG. 3D represents elapsed time (sec) and the vertical axis represents voltage (V). FIG. 3A shows the stop signal STOP when supplied. The horizontal axis of FIG. 3A represents the elapsed time (sec) and the vertical axis represents the voltage of the stop signal STOP.

Immediately after the stop signal STOP falls from "H" to "L" at the time of 500 ns as shown in FIG. 3A, the current I2 flowing through the discharge path DP2 is predominant to cause short-time discharge. As a result, the output voltage Vout from the current source cell SL rises quickly as shown in FIG. 3D. However, after the NMOS transistor M21 turns off, the current I1 flowing through the conventional path becomes predominant, slowing down changes in output voltage Vout.

The transition time required for the stop signal STOP to fall to cause the D-A converter to make the standby-state to operating-state transition (defined herein as the time required for the output voltage Vout which is 0 V at the time of 500 ns to reach the operating-state value of the output voltage Vout±1 LSB) when the reference voltage generator circuit RG2 is used is reduced by about 60% as compared with the characteristic shown in FIG. 3B which is obtained when the background art reference voltage generator circuit RG is used.

Since a voltage input-output characteristic curve for the inverter IV1 is not steep, a slight short circuit current 13 flows when the inverter IV1 is in operation. For illustration of such a phenomenon, FIG. 6A shows the voltage input-output characteristic of the inverter IV1, and FIG. 6B shows a short circuit current characteristic versus the input voltage to the inverter IV1.

Figure 6A:
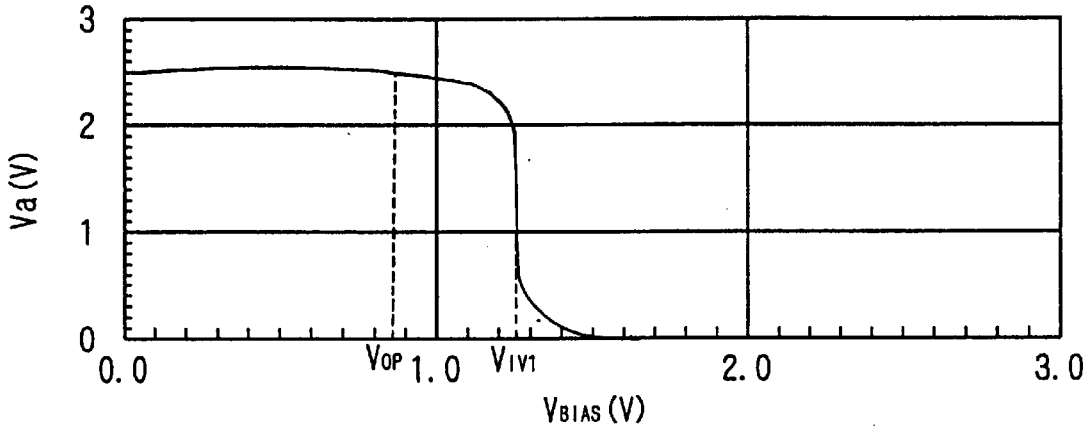
FIGS. 6A and 6B illustrate discharge path characteristics of the semiconductor integrated circuit device according to the second preferred embodiment of the present invention.

The horizontal axis of FIG. 6A represents the input voltage to the inverter IV1, i.e. the reference voltage $V_{BIAS}$ (V), and the vertical axis represents the output voltage Va (V) therefrom. The horizontal axis of FIG. 6B represents the input voltage to the inverter IV1, i.e. the reference voltage $V_{BIAS}$ (V), and the vertical axis represents the short circuit current 13 ($\mu$A) flowing through the inverter IV1.

Figure 6B:
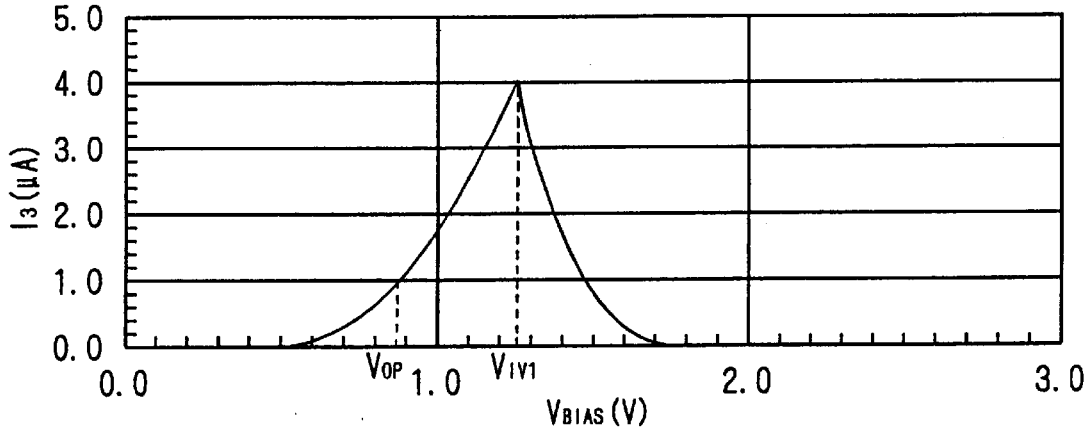

Since the voltage input-output characteristic curve for the inverter IV1 is not steep as shown in FIG. 6A, the short circuit current characteristic exhibits a broad, inverted V-shaped curve with a peak at the threshold value $V_{IV1}$ of the inverter IV1 as shown in FIG. 6B. The foot of the curve of FIG. 6B covers a range including the operating voltage Vop which equals the reference voltage $V_{BIAS}$ provided when the D-A converter is in operation. Therefore, current flows also when the D-A converter is in operation. The value of this current may be decreased by setting the size of the NMOS transistors M17 and M18 so that the threshold value $V_{IV1}$ of the inverter IV1 is higher than the operating voltage Vop. This, however, provides a gentle rising edge of the output voltage Vout from the current source cell SL, resulting in prolonged transition time required for the D-A converter to make the standby-state to operating-state transition.

Conversely, when the threshold value $V_{IV1}$ of the inverter IV1 is adapted to approach the operating voltage Vop, the transition time is reduced but the short circuit current characteristic curve shown in FIG. 6B shifts toward the operating voltage Vop, resulting in the increase in short circuit current.

The reference voltage generator circuit RG2 has the advantage of setting the threshold value $V_{IV1}$ of the inverter IV1 to any value according to the size of the NMOS transistors M17 and M18. In this setting, a margin is set to the threshold value of the inverter IV1 in consideration for the above-described short circuit current characteristic and variations in transistor manufacturing process.

The inverter IV2 merely inverts and amplifies the output from the inverter IV1 to provide a voltage input-output characteristic which exhibits a steep curve.

When the threshold value $V_{IV1}$ of the inverter IV1 is lower than the operating voltage Vop ($V_{IV1}$<Vop), the operating voltage of the D-A converter is changed to cause the D-A converter not to operate normally.

<B-3. Function and Effect>

As described hereinabove, the reference voltage generator circuit RG2 comprises the discharge path DP2 for discharging the electric charges stored at the gates of the PMOS transistors M1 and M2 of the current source cell SL to shorten the discharge time, thereby reducing the time required for the D-A converter to make the standby-state to operating-state transition.

Additionally, the size of the PMOS transistor M17 and the NMOS transistor M18 which constitute the inverter IV1 for on-off controlling the discharge path DP2 may be changed to set the threshold value $V_{IV1}$ of the inverter IV1 to any value. Thus, the time required for the D-A converter to make the standby-state to operating-state transition may be set to any value.

When the D-A converter is in the standby state, the reference voltage $V_{BIAS}$ generated by the reference voltage generator circuit RG2 equals the power supply voltage, and there is no path of current flowing from the power supply $V_{DD}$ to the ground (GND) in the reference voltage generator circuit RG2 and the current source cell SL. This reduces power consumption.

<B-4. Modification>

Figure 7:
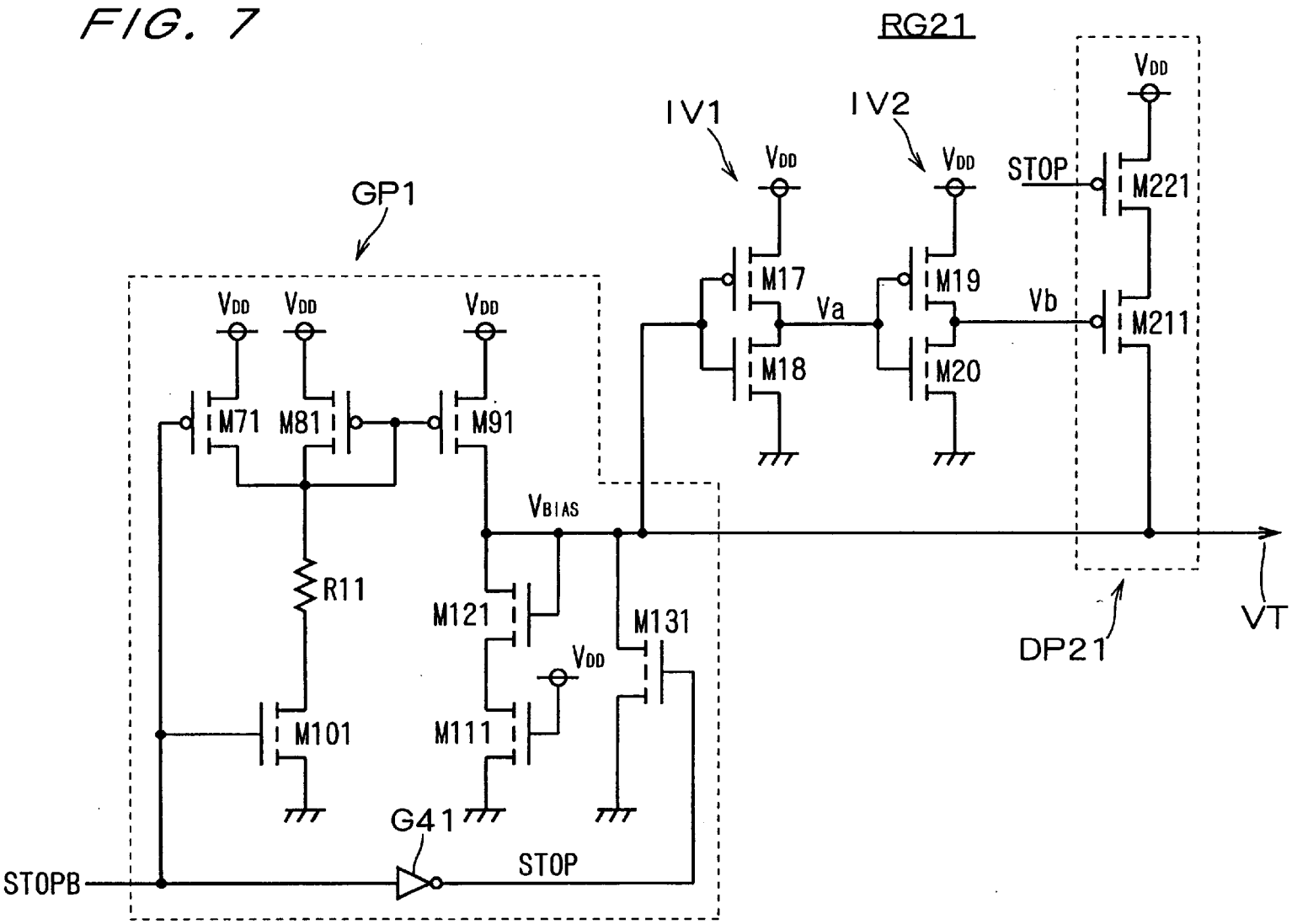
FIG. 7 shows a construction of a modification of the semiconductor integrated circuit device according to the second preferred embodiment of the present invention.

The above described reference voltage generator circuit RG2 according to the second preferred embodiment of the present invention is designed to discharge the electric charges in the MOS transistor when the MOS transistor serving as the current source of the current source cell is of P-channel type. When the current source is an NMOS transistor, the NMOS transistor is required to store electric charges therein. A reference voltage generator circuit RG21 as shown in FIG. 7 is applied to such a requirement.

The reference voltage generator circuit RG21 comprises the voltage generator GP1, a charge path DP21 including PMOS transistors M211 and M221, and the inverters IV1 and IV2 for on-off controlling the charge path DP21. The voltage generator GP1 of the reference voltage generator circuit RG21 is similar in construction to that of the reference voltage generator circuit RG11 described with reference to FIG. 4, and the inverters IV1 and IV2 of the reference voltage generator circuit RG21 are similar in construction to those of the reference voltage generator circuit RG2 described with reference to FIG. 5. Duplicate description thereon will be omitted herein.

In the charge path DP21, the output end VT of the reference voltage $V_{BIAS}$ is connected to the drain of the PMOS transistor M211. The source of the PMOS transistor M211 is connected to the drain of the PMOS transistor M221. The source of the PMOS transistor M221 is connected to the power supply $V_{DD}$.

In the charge path DP21, the PMOS transistor M211 is on-off controlled by the inverted signal of the output from the inverter IV1 which receives the reference voltage $V_{BIAS}$. The stop signal STOP is applied to the PMOS transistor M221 so that the PMOS transistor M221 serves as a switch which is on when the D-A converter is in operation and is off when the D-A converter is on standby.

With such an arrangement, when the D-A converter is in the standby state (when the system is suspended), the reference voltage $V_{BIAS}$ generated by the reference voltage generator circuit RG21 equals the ground potential. This reduces power consumption. Further, when the inverted stop signal STOPB changes from "L" to "H" to cause the D-A converter to make the standby-state to operating-state transition, electric charges are supplied through the charge path DP21 to the gate of the NMOS transistor serving as the current source of the current source cell. This shortens the charge time, thereby to reduce the time required for the D-A converter to make the standby-state to operating-state transition.

The discharge path DP2 in the reference voltage generator circuit RG2 shown in FIG. 5 and the charge path DP21 in the reference voltage generator circuit RG21 shown in FIG. 7 are means for causing the gate voltage of the transistor serving as the current source of the current source cell to quickly approach the operating voltage Vop to determine the voltage, and may therefore be referred generically as voltage determination means.

<C. Third Preferred Embodiment>

<C-1. Device Construction>

Figure 8:
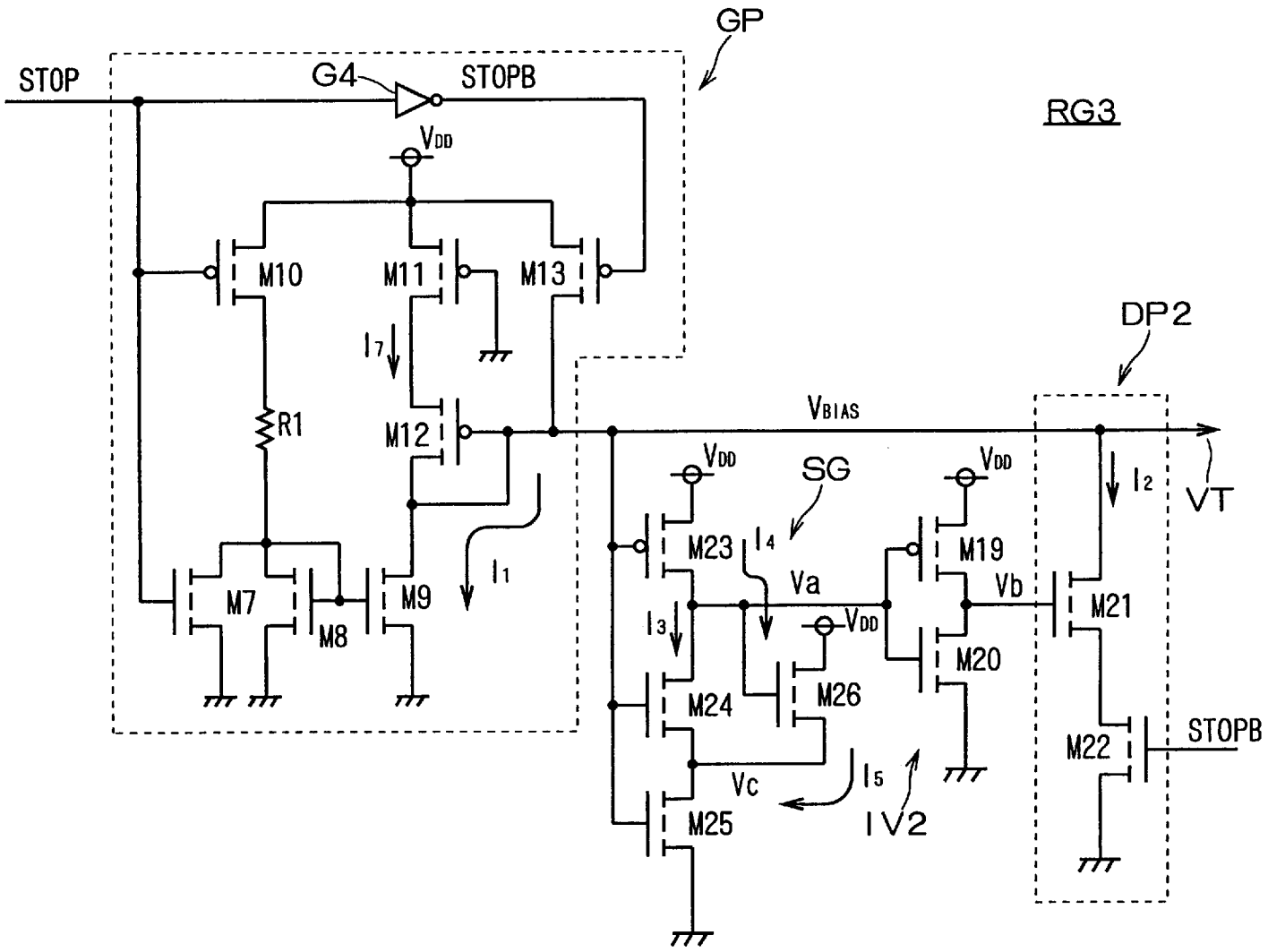
FIG. 8 shows a construction of the semiconductor integrated circuit device according to a third preferred embodiment of the present invention.

FIG. 8 shows the construction of a reference voltage generator circuit RG3 according to a third preferred embodiment of the present invention. As illustrated in FIG. 8, the reference voltage generator circuit RG3 comprises the discharge path DP2 including the NMOS transistors M21 and M22, and a Schmitt gate SG and the inverter IV2 for on-off controlling the discharge path DP2 in addition to the voltage generator GP including the NMOS transistors M7, M8, M9, the PMOS transistors M10, M11, M12, M13, the inverter G4 and the resistor R1. The Schmitt gate SG and the inverter IV2 may be generically referred to as a controller.

The voltage generator GP of the reference voltage generator circuit RG3 is similar in construction to that of the reference voltage generator circuit RG1 described with reference to FIG. 1, and the discharge path DP2 and the inverter IV2 of the reference voltage generator circuit RG3 are similar in construction to those of the reference voltage generator circuit RG2 described with reference to FIG. 5. Duplicate description thereon will be omitted herein.

The Schmitt gate SG comprises a PMOS transistor M23 having a source connected to the power supply $V_{DD}$, an NMOS transistor M24 having a drain connected to the drain of the PMOS transistor M23, an NMOS transistor M25 having a drain connected to the source of the NMOS transistor M24 and a source grounded, and an NMOS transistor M26 having a drain connected to the power supply $V_{DD}$ and a source connected to the source of the NMOS transistor M24.

The gates of the PMOS transistor M23 and the NMOS transistors M24, M25 are connected to the output end VT of the reference voltage $V_{BIAS}$, and the gate of the NMOS transistor M26 is connected to the output of the Schmitt gate SG, i.e. the drain of the PMOS transistor M23.

The gates of the PMOS transistor M19 and the NMOS transistor M20 in the inverter IV2 are connected to the output of the Schmitt gate SG, i.e. the drain of the PMOS transistor M23.

The gate of the NMOS transistor M21 in the discharge path DP2 is connected to the output of the inverter IV2, i.e. the drains of the PMOS transistor M19 and the NMOS transistor M20.

The stop signal STOP which is one of the control signals provided from the exterior of the D-A converter is input to the gate of the PMOS transistor M10 and the gate of the NMOS transistor M7. The inverted stop signal STOPB obtained by inverting the stop signal STOP in the inverter G4 is input to the gate of the PMOS transistor M13 and the gate of the NMOS transistor M22.

In the discharge path DP2, the NMOS transistor M21 is on-off controlled by the inverted signal of the output from the Schmitt gate SG which receives the reference voltage $V_{BIAS}$. The inverted stop signal STOPB is applied to the NMOS transistor M22 so that the NMOS transistor M22 serves as a switch which is on when the D-A converter is in operation and is off when the D-A converter is on standby.

<C-2. Device Operation>

The operation of the reference voltage generator circuit RG3 will be discussed below.

When the potential of the stop signal STOP is switched from the high level (referred to hereinafter as "H" ) to the low level (referred to hereinafter as "L" ) for the standby-state to operating-state transition of the D-A converter, the PMOS transistor M13 turns off and the NMOS transistors M9 and M22 turn on. Since the voltage generator GP holds the reference voltage $V_{BIAS}$ at the voltage of the power supply $V_{DD}$ when the DA converter is in the standby state, the reference voltage $V_{BIAS}$ is approximately equal to the power supply voltage ($V_{DD}$) immediately after the stop signal STOP is switched. Hence, the NMOS transistors M24 and M25 turn on. The output voltage Va from the Schmitt gate SG is "L," and the output voltage Vb from the inverter IV2 is "H." Then, the NMOS transistor M21 turns on. Since the NMOS transistor M22 also turns on, the current I1 flows through the conventional path extending from the output end VT around the PMOS transistor M12 to the NMOS transistor M9, and the current 12 flows through the discharge path DP2 including the NMOS transistors M21 and M22, thereby to discharge electric charges stored at the gates of the PMOS transistors M1 and M2 of the current source cell SL shown in FIG. 12. The initial discharge rate may be set to any value according to the size of the NMOS transistor M21.

When the discharge proceeds to decrease the voltage $V_{BIAS}$ to near the threshold voltage of the PMOS transistor M23, the PMOS transistor M23 turns on. Then, current I4 flowing from the power supply $V_{DD}$ through the PMOS transistor M23 charges the gate of the NMOS transistor M26 to increase the output voltage Va from the Schmitt gate SG.

When the gate voltage of the NMOS transistor M26 exceeds the threshold value thereof, the NMOS transistor M26 turns on. Then, current I5 flowing from the power supply $V_{DD}$ through the NMOS transistor M26 increases voltage Vc at the connection of the NMOS transistors M24 and M25 to decrease the gate-source voltage of the NMOS transistor M24, thereby turning off the NMOS transistor M24. Turning off the NMOS transistor M24 changes the output voltage Va to "H" and changes the output voltage Vb from the inverter IV2 to "L" to turn off the NMOS transistor M21.

When the NMOS transistor M21 turns off, the discharge caused by the current I1 flowing through the conventional path decreases the voltage $V_{BIAS}$ at the output end VT to the operating voltage Vop which equals the reference voltage $V_{BIAS}$ provided when the D-A converter is in operation.

Figure 3E:
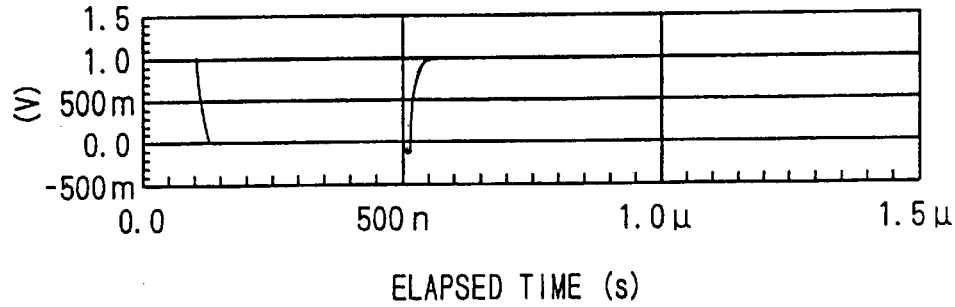

FIG. 3E shows a circuit simulation result of the D-A converter when the reference voltage generator circuit RG3 is used. Specifically, FIG. 3E shows plots of the output voltage Vout from the current source cell SL when all bits of input digital code applied to the X-decoder XD and the Y-decoder YD are "1" and the stop signal STOP rises from "L" (i.e. 0 V ) to "H" (i.e. full scale) at the time of 100 ns (nsec) and falls from "H" to "L" at the time of 500 ns as shown in FIG. 3A. The horizontal axis of FIG. 3E represents elapsed time (sec) and the vertical axis represents voltage (V). FIG. 3A shows the stop signal STOP when supplied. The horizontal axis of FIG. 3A represents the elapsed time (sec) and the vertical axis represents the voltage of the stop signal STOP.

Immediately after the stop signal STOP falls from "H" to "L" at the time of 500 ns as shown in FIG. 3A, the current 12 flowing through the discharge path DP2 is predominant to cause short-time discharge. As a result, the output voltage Vout from the current source cell SL rises very quickly as shown in FIG. 3E. The proportion of the current I1 through the conventional path contributing to discharge after the NMOS transistor M21 turns off in the third preferred embodiment is less than that in the first and second preferred embodiments shown in FIGS. 3C and 3D.

The transition time required for the stop signal STOP to fall to cause the D-A converter to make the standby-state to operating-state transition (defined herein as the time required for the output voltage Vout which is 0 V at the time of 500 ns to reach the operating-state value of the output voltage Vout±1 LSB) when the reference voltage generator circuit RG3 is used is reduced by about 90% as compared with the characteristic shown in FIG. 3B which is obtained when the background art reference voltage generator circuit RG is used.

Figure 9:
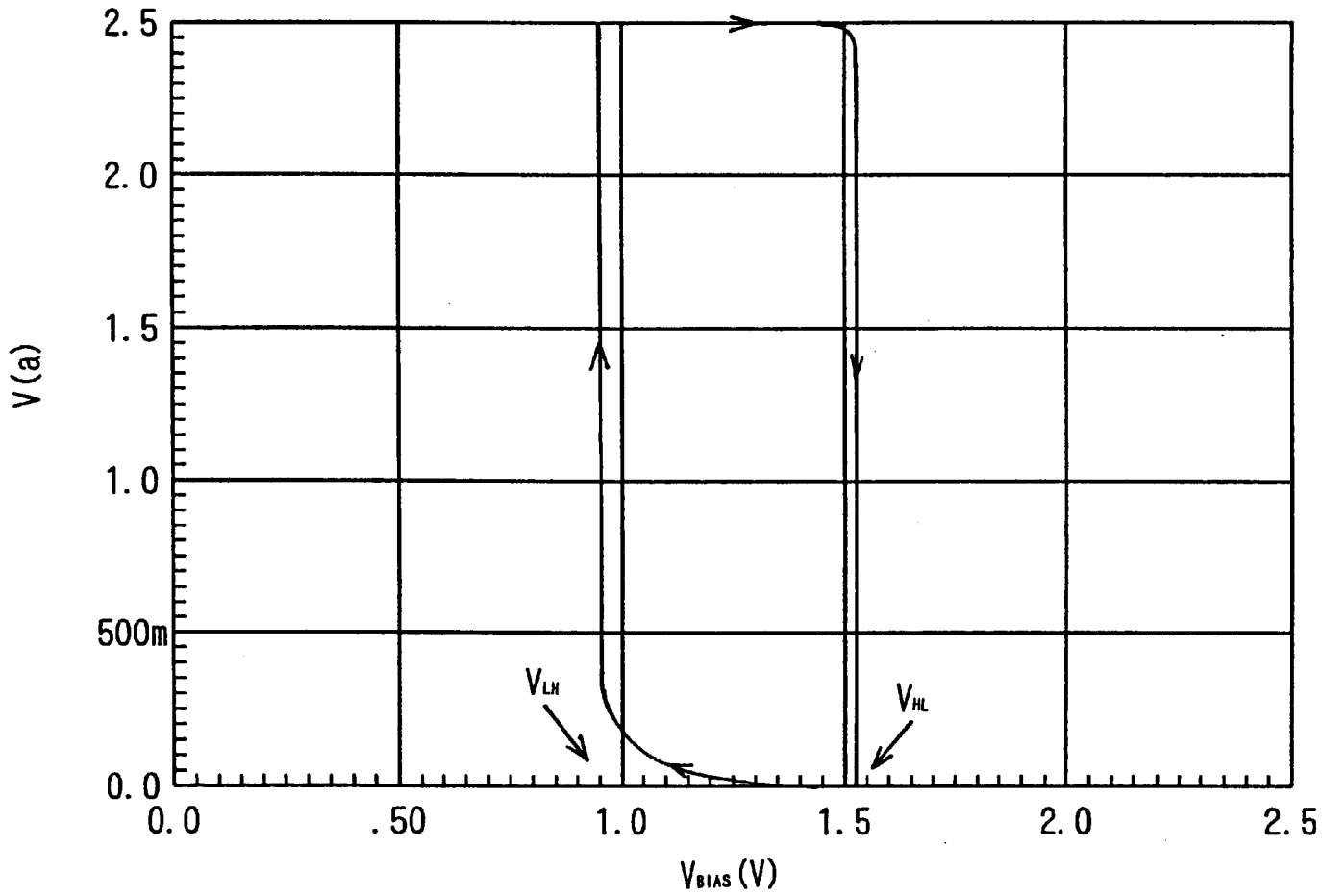
FIG. 9 illustrates discharge path characteristics of the semiconductor integrated circuit device according to the third preferred embodiment of the present invention.

FIG. 9 shows a voltage input-output characteristic of the Schmitt gate SG. The horizontal axis of FIG. 9 represents the input voltage to the Schmitt gate SG, i.e. the reference voltage $V_{BIAS}$ (V), and the vertical axis represents the output voltage Va (V) from the Schmitt gate SG. A threshold voltage VHL for switching of the output voltage Va from "H" to "L" and a threshold voltage $V_{LH}$ for switching of the output voltage Va from "L" to "H" are represented by the arrows of FIG. 9.

Once the output voltage Va is switched to "H," the current 15 holds the source potential of the NMOS transistor M24 at a high level. This makes the NMOS transistor M24 to difficult to turn on. Then, the characteristic of the Schmitt gate exhibits a hysteresis curve as shown in FIG. 9.

The size of the PMOS transistor M23 and the NMOS transistors M24 and M25 is determined so that the threshold voltage $V_{LH}$ is approximately equal to the operating voltage Vop which equals the reference voltage $V_{BIAS}$ provided when the D-A converter is in operation. The threshold voltage $V_{HL}$ is determined by the size of the NMOS transistor M26.

The change in output voltage Va from the Schmitt gate SG when the reference voltage $V_{BIAS}$ changes from "H" to "L" is steeper than that in output voltage Va from the inverter IV1 of the second preferred embodiment described with reference to FIG. 6. The short circuit current I3 flowing from the power supply $V_{DD}$ through the Schmitt gate SG to the ground when the D-A converter is in operation is negligibly small.

Since the input-output characteristic of the Schmitt gate SG exhibits the hysteresis curve, the output voltage Va, once switched to "H," is not changed by some variations in reference voltage $V_{BIAS}$ due to overshoot, undershoot and the like. Hence, the NMOS transistor M21 is held off with stability.

The Schmitt gate SG is advantageous in that the D-A converter operates normally when $Vop<V_{HL}$ even if the operating voltage Vop which equals the reference voltage VBLAS provided when the D-A converter is in operation and the threshold voltage $V_{LH}$ are deviated due to variations in the process of manufacturing the voltage generator GP and the Schmitt gate SG to result in Vop>$V_{LH}$. In other words, the Schmitt gate SG is a circuit less susceptible to variations in the transistor manufacturing process.

When Vop>$V_{LH}$, the discharge caused by the current 12 decreases the reference voltage once to the threshold voltage $V_{LH}$ to turn off the NMOS transistor M21. Thereafter, current 17 flowing from the power supply $V_{DD}$ through the PMOS transistor M11 in the voltage generator GP increases the reference voltage $V_{BIAS}$ up to the operating voltage Vop which equals the reference voltage $V_{BIAS}$ provided when the D-A converter is in operation.

<C-3. Function and Effect>

As described hereinabove, the reference voltage generator circuit RG3 comprises the discharge path DP2 for discharging the electric charges stored at the gates of the PMOS transistors M1 and M2 of the current source cell SL to shorten the discharge time, thereby reducing the time required for the D-A converter to make the standby-state to operating-state transition.

Additionally, the Schmitt gate SG having the input-output characteristic which exhibits the hysteresis curve generates the control signal for on-off control of the discharge path DP2 based on the reference voltage $V_{BIAS}$. Therefore, the control signal is not changed by some variations in reference voltage $V_{BIAS}$, and the on-off control of the discharge path DP2 is stabilized.

Further, the Schmitt gate SG is less susceptible to variations in the process of manufacturing the transistors of the voltage generator GP and the Schmitt gate SG. This provides the reference voltage generator circuit which is low in failure rate and high in manufacturing yield.

When the D-A converter is in the standby state, the reference voltage $V_{BIAS}$ generated by the reference voltage generator circuit RG3 equals the power supply voltage, and there is no path of current flowing from the power supply $V_{DD}$ to the ground (GND) in the reference voltage generator circuit RG3 and the current source cell SL. This reduces power consumption.

<C-4. Modification>

Figure 10:
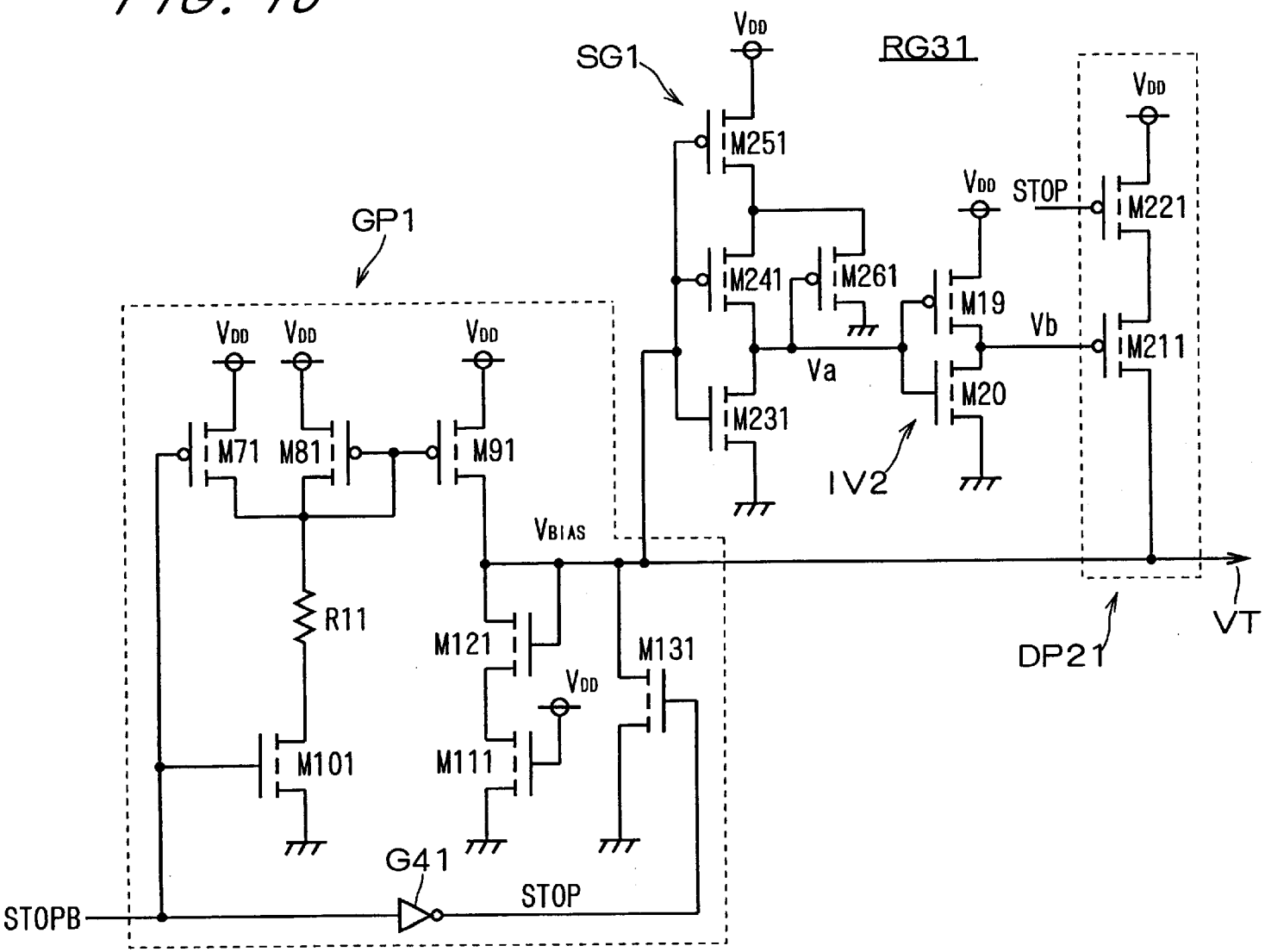
FIG. 10 shows a construction of a modification of the semiconductor integrated circuit device according to the third preferred embodiment of the present invention.

The above described reference voltage generator circuit RG3 according to the third preferred embodiment of the present invention is designed to discharge the electric charges in the MOS transistor when the MOS transistor serving as the current source of the current source cell is of P-channel type. When the current source is an NMOS transistor, the NMOS transistor is required to store electric charges therein. A reference voltage generator circuit RG31 as shown in FIG. 10 is applied to such a requirement.

The reference voltage generator circuit RG31 comprises the charge path DP21, and a Schmitt gate SG1 and the inverter IV2 for on-off controlling the charge path DP21 in addition to the voltage generator GP1.

The voltage generator GP1 and the charge path DP21 of the reference voltage generator circuit RG31 are similar in construction to those of the reference voltage generator circuit RG21 described with reference to FIG. 7, and the inverter IV2 of the reference voltage generator circuit RG31 is similar in construction to that of the reference voltage generator circuit RG3 described with reference to FIG. 8. Duplicate description thereon will be omitted herein.

The Schmitt gate SG1 comprises an NMOS transistor M231 having a source grounded, a PMOS transistor M241 having a drain connected to the drain of the NMOS transistor M231, a PMOS transistor M251 having a drain connected to the source of the PMOS transistor M241 and a source connected to the power supply $V_{DD}$, and a PMOS transistor M261 having a drain grounded and a source connected to the source of the PMOS transistor M241.

The gates of the NMOS transistor M231 and the PMOS transistors M241, M251 are connected to the output end VT of the reference voltage $V_{BIAS}$, and the gate of the PMOS transistor M261 is connected to the output of the Schmitt gate SG1, i.e. the drain of the NMOS transistor M231.

The gates of the PMOS transistor M19 and the NMOS transistor M20 in the inverter IV2 are connected to the output of the Schmitt gate SG1, i.e. the drain of the NMOS transistor M231.

The inverted stop signal STOPB which is one of the control signals provided from the exterior of the D-A converter is input to the gate of the PMOS transistor M71 and the gate of the NMOS transistor M101. The stop signal STOP obtained by inverting the inverted stop signal STOPB in the inverter G41 is input to the gate of the PMOS transistor M221 and the gate of the NMOS transistor M131.

In the charge path DP21, the NMOS transistor M211 is on-off controlled by the inverted signal of the output from the Schmitt gate SG1 which receives the reference voltage $V_{BIAS}$. The stop signal STOP is applied to the PMOS transistor M221 so that the PMOS transistor M221 serves as a switch which is on when the D-A converter is in operation and is off when the D-A converter is on standby.

With such an arrangement, when the D-A converter is in the standby state (when the system is suspended), the reference voltage $V_{BIAS}$ generated by the reference voltage generator circuit RG31 equals the ground potential. This reduces power consumption. Further, when the inverted stop signal STOPB changes from "L" to "H" to cause the D-A converter to make the standby-state to operating-state transition, electric charges are supplied through the charge path DP21 to the gate of the NMOS transistor serving as the current source of the current source cell. This shortens the charge time, thereby to reduce the time required for the D-A converter to make the standby-state to operating-state transition.

The Schmitt gate SG1 may be similar in construction to the Schmitt gate SG shown in FIG. 8.

<D. Another Application of Voltage Determination Means>

The reference voltage generator circuit for the current cell matrix type D-A converter comprises the voltage determination means in the first to third preferred embodiments of the present invention. However, the present invention is applicable to various semiconductor integrated circuit devices which incorporate the reference voltage generator circuit therein and which are required to quickly determine the gate voltage of MOS transistors.

While the invention has been described in detail, the foregoing description is in all aspects illustrative and not restrictive. It is understood that numerous other modifications and variations can be devised without departing from the scope of the invention.

What is claimed is:

1. A semiconductor integrated circuit device comprising:

a first circuit serving as main circuit and including a current source transistor; and a second circuit for generating a control voltage to be applied to a control electrode of said current source transistor of said first circuit, said second circuit being operative to turn off and on said current source transistor by setting said control voltage at first and second voltages thereby to place said first circuit in a standby state and in an operating state, respectively, said second circuit comprising:

a current source and an output voltage setting device connected between first and second power supplies, said output voltage setting device setting an output voltage from said current source at said second voltage;

an output end for outputting at least said output voltage from said current source as said control voltage; and voltage determination means connected between said output end and said second power supply, said voltage determination means forcing voltage of said control electrode of said current source transistor to approach said second voltage when said first circuit is being placed in said operating state.

2. The semiconductor integrated circuit device according to claim 1, wherein said voltage determination means comprises at least one diode-connected transistor connected between said output end and said second power supply, and wherein said voltage determination means forces the voltage of said control electrode of said current source transistor to approach said second voltage until the voltage of said control electrode of said current source transistor reaches a threshold voltage of said at least one diode-connected transistor when placing said first circuit in said operating state.

3. The semiconductor integrated circuit device according to claim 2, wherein said second circuit further comprises switching means connected between said first power supply and said output end for making and breaking connection between said first power supply and said output end, wherein said at least one diode-connected transistor of said voltage determination means comprises:

a first transistor of a first conductivity type having a first main electrode connected to said output end, a second main electrode, and a control electrode connected to said first main electrode of said first transistor;

a second transistor of said first conductivity type having a first main electrode connected to said second main electrode of said first transistor, a second main electrode, and a control electrode connected to said first main electrode of said second transistor; and a third transistor of said first conductivity type having a first main electrode connected to said second main electrode of said second transistor, a second main electrode connected to said second power supply, and a control electrode, and wherein said switching means comprises a fourth transistor of a second conductivity type having a first main electrode connected to said first power supply, a second main electrode connected to said output end, and a control electrode, said control electrodes of said third and fourth transistors receiving a control signal for turning off said third transistor and turning on said fourth transistor when placing said first circuit in said standby state.

4. The semiconductor integrated circuit device according to claim 1, wherein said voltage determination means comprises at least a transistor connected between said output end and said second power supply, wherein said second circuit further comprises at least one inverter for on-off controlling said transistor, said at least one inverter having an input connected to said output end, said transistor being on-off controlled based on an output from said at least one inverter, and wherein said transistor is held on until the voltage of said control electrode of said current source transistor reaches a threshold voltage of said at least one inverter when placing said first circuit in said operating state.

5. The semiconductor integrated circuit device according to claim 4, wherein said second circuit further comprises switching means connected between said first power supply and said output end for making and breaking connection between said first power supply and said output end, wherein said at least one inverter comprises first and second inverters connected in series, said first inverter having an input connected to said output end, and an output, said second inverter having an input connected to said output of said first inverter, and an output, wherein said at least a transistor of said voltage determination means comprises:

a first transistor of a first conductivity type having a first main electrode connected to said output end, a second main electrode, and a control electrode connected to said output of said second inverter; and a second transistor of said first conductivity type having a first main electrode connected to said second main electrode of said first transistor, a second main electrode connected to said second power supply, and a control electrode, and wherein said switching means comprises a third transistor of a second conductivity type having a first main electrode connected to said first power supply, a second main electrode connected to said output end, and a control electrode, said control electrodes of said second and third transistors receiving a control signal for turning off said second transistor and turning on said third transistor when placing said first circuit in said standby state.

6. The semiconductor integrated circuit device according to claim 1, wherein said voltage determination means comprises at least a transistor connected between said output end and said second power supply, wherein said second circuit further comprises a controller for on-off controlling said transistor, said controller including at least a Schmitt gate, said Schmitt gate having an input connected to said output end, said transistor being on-off controlled based on an output from said Schmitt gate, said Schmitt gate having a first threshold voltage for specifying voltage at which said output changes from a first level to a second level, and a second threshold voltage for specifying voltage at which said output changes from said second level to said first level, and wherein said transistor is held on until the voltage of said control electrode of said current source transistor reaches said first threshold voltage of said Schmitt gate when placing said first circuit in said operating state.

7. The semiconductor integrated circuit device according to claim 6, wherein said second circuit further comprises switching means connected between said first power supply and said output end for making and breaking connection between said first power supply and said output end, wherein said controller further includes an inverter having an input connected to said output of said Schmitt gate, and an output, wherein said at least a transistor of said voltage determination means comprises:

a first transistor of a first conductivity type having a first main electrode connected to said output end, a second main electrode, and a control electrode connected to said output of said inverter; and a second transistor of said first conductivity type having a first main electrode connected to said second main electrode of said first transistor, a second main electrode connected to said second power supply, and a control electrode, wherein said Schmitt gate comprises:

a third transistor of said first conductivity type having a first main electrode connected to said second power supply, a second main electrode, and a control electrode;

a fourth transistor of said first conductivity type having a first main electrode connected to said second main electrode of said third transistor, a second main electrode, and a control electrode;

a fifth transistor of a second conductivity type having a first main electrode connected to said second main electrode of said fourth transistor, a second main electrode connected to said first power supply, and a control electrode; and a sixth transistor of said first conductivity type having a first main electrode connected to said first main electrode of said fourth transistor, a second main electrode connected to said first power supply, and a control electrode, said control electrodes of said third, fourth and fifth transistors being connected to said output end, said control electrode of said sixth transistor being connected to said first main electrode of said fifth transistor serving as said output of said Schmitt gate, and wherein said switching means comprises a seventh transistor of said second conductivity type having a first main electrode connected to said first power supply, a second main electrode connected to said output end, and a control electrode, said control electrodes of said second and seventh transistors receiving a control signal for turning off said second transistor and turning on said seventh transistor when placing said first circuit in said standby state.

* * * * *